US011205828B2

(12) United States Patent
Behdad et al.

(10) Patent No.: US 11,205,828 B2
(45) Date of Patent: Dec. 21, 2021

(54) 2-BIT PHASE QUANTIZATION WAVEGUIDE

(71) Applicant: Wisconsin Alumni Research Foundation, Madison, WI (US)

(72) Inventors: Nader Behdad, Oregon, WI (US); John H. Booske, McFarland, WI (US); Hung Thanh Luyen, Madison, WI (US); Zongtang Zhang, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 171 days.

(21) Appl. No.: 16/735,846

(22) Filed: Jan. 7, 2020

(65) Prior Publication Data

US 2021/0280955 A1 Sep. 9, 2021

(51) Int. Cl.

| | |
|---|---|
| ***H01P 3/123*** | (2006.01) |
| ***H01P 1/165*** | (2006.01) |
| ***H01Q 21/00*** | (2006.01) |
| ***H01Q 1/50*** | (2006.01) |

(52) U.S. Cl.

CPC ..... *H01P 3/123* (2013.01); *H01P 1/165* (2013.01); *H01Q 1/50* (2013.01); *H01Q 21/0006* (2013.01)

(58) Field of Classification Search

CPC ..... H01P 3/123; H01P 1/165; H01Q 1/50; H01Q 21/006

USPC ..... 333/21 A

See application file for complete search history.

(56) References Cited

U.S. PATENT DOCUMENTS

| | | | |
|---|---|---|---|
| 3,668,563 | A | 6/1972 | Siekanowicz |
| 4,725,795 | A | 2/1988 | Ajioka et al. |
| 5,095,292 | A | 3/1992 | Masterton |
| 6,028,562 | A | 2/2000 | Guler et al. |
| 6,493,473 | B1 | 12/2002 | Wooten |
| 8,248,178 | B2 | 8/2012 | Lange |
| 8,542,081 | B2 | 9/2013 | Parekh et al. |
| 8,587,492 | B2 | 11/2013 | Runyon |
| 9,912,073 | B2 | 3/2018 | Anderson et al. |
| 10,073,177 | B2 | 9/2018 | Montoya et al. |
| 10,320,084 | B2 | 6/2019 | Bily et al. |
| 2020/0243968 | A1 | 7/2020 | Behdad et al. |

OTHER PUBLICATIONS

Balanis, Constantine A. Advanced, Engineering Electromagnetics 466-470 (2d ed. Wiley 2012) 8.10 Ridged Waveguide.

*Primary Examiner* — Robert J Pascal
*Assistant Examiner* — Kimberly E Glenn
(74) *Attorney, Agent, or Firm* — Bell & Manning, LLC

(57) ABSTRACT

A waveguide includes a first double-ridge waveguide, a second double-ridge waveguide, and a polarization rotator. The first double-ridge waveguide provides a phase of an input electrical field rotated 0° or 90°. The second double-ridge outputs an electric field with a polarization that is perpendicular to a first polarization of the input electrical field. The polarization rotator is mounted between the first double-ridge waveguide and the second double-ridge waveguide and includes a frame, a dielectric layer, a first conducting pattern layer forming a first conductor and a second conductor, a first switch connected between the first conductor and the second conductor, a second conducting pattern layer forming a third conductor and a fourth conductor, and a second switch connected between the third conductor and the fourth conductor. Wherein a phase rotation of 90° or −90° is provided by the polarization rotator based on a state of the first and second switch.

20 Claims, 17 Drawing Sheets

2-BIT PHASE QUANTIZATION WAVEGUIDE

REFERENCE TO GOVERNMENT RIGHTS

This invention was made with government support under N00014-16-1-2308 awarded by the US Navy/ONR. The government has certain rights in the invention.

BACKGROUND

A phased array antenna is an array of antennas in which a relative phase of signals feeding each antenna is varied such that an effective radiation pattern of the array is reinforced in a desired direction and suppressed in undesired directions to provide electronic steering of a beam. Beams are formed by shifting the phase of the signal emitted from each radiating element to provide either constructive or destructive interference to steer the beam. These antenna systems come in different sizes and scales due to several factors such as frequency and power requirements.

Each unit cell of the phased array antenna is configured to apply a specific phase shift to realize a desired phase profile over the array's aperture to form a high gain pencil beam at an intended direction. The direction of the main beam can be steered by adaptively changing the phase of each array element. Ideally, it is desirable to have the phased array antenna's unit cells that can be reconfigured to yield any arbitrary phase shift values between 0° and 360° to provide perfect phase correction. However, the reconfiguration techniques to achieve any arbitrary phase shift values between 0° and 360° require changing the control voltage continuously and individually configuring the unit cells, which results in a relatively sophisticated architecture for voltage supply circuitry. Moreover, it is challenging to realize the full, reconfigurable 0° to 360° phase range over a broad frequency range (e.g., with fractional bandwidth of larger than 10%).

As a result, high-power phased array antenna technology that yields an affordable system is a major problem in the commercial and military wireless industry. Additionally, the solid-state technology that lies at the heart of current phased array antenna technology has inherent limitations when it comes to power and heat handling capability due to the generation of a large amount of heat. These limitations reduce the practicality of these reconfiguration techniques for various scenarios where phased array antennas having large numbers of unit cells and wideband operation are needed. Therefore, instead of fulfilling a continuous 0° to 360° phase range, discrete phase correction schemes that quantize this phase range into a number of discrete levels have been widely adopted in order to reduce the complexity of the control circuitry and increase operating bandwidths of beam-steerable phased array antennas.

The simplest phase quantization scheme is 1-bit, which has been demonstrated as sufficient for beam scanning operation. The use of two phase states for reconfigurable unit cells significantly reduces the complexity of the unit cell design and the digital control circuit compared to a phase correction scheme using a higher number of phase states. However, 1-bit discretization results in a large phase error accumulated over a phased array antenna's aperture reducing the directivity by about 3.7 decibel (dB) compared to that achieved by a perfectly collimated phased array antenna. Improving the phase quantization to 2-bit (e.g., four phase states) helps recover about 3 dB of this 3.7-dB directivity reduction, which is a significant improvement. Increasing the number of phase states beyond four yields only a modest increase in the directivity of less than 0.7 dB. This modest increase can be easily canceled by the higher losses due to additional switches and more complicated unit cell designs. Indeed, a number of publications reveal that an average phase shifter loss is about 1 dB/bit. This means adding one more bit to the phase correction scheme generally increases the overall system loss by 1 dB. Taking into account this phase shifter loss, an array using 3-bit phase shifters, while providing about a 0.5 dB higher directivity gain, provides a slightly lower realized gain compared to one using 2-bit phase shifters. In an electronically reconfigurable phased array antenna, a large fraction of the fabrication cost is often due to the switches (e.g., PIN-diode, MEMS switches) used for reconfiguration. Therefore, moving from a 1-bit to a 2-bit phase quantization scheme for reconfigurable phased array antennas provides the biggest performance improvement.

SUMMARY

In an illustrative embodiment, a waveguide is provided. The waveguide includes, but is not limited to, a first double-ridge waveguide, a second double-ridge waveguide, and a polarization rotator. The first double-ridge waveguide is formed of a first electrically conductive material. The first double-ridge waveguide is configured to generate a first electric field having a first polarization in response to an input electrical field having the first polarization or to generate a second electric field having the first polarization in response to the input electrical field. A first phase of the first electric field is rotated 0 degrees relative to a phase of the input electrical field when the input electrical field is applied to the first double-ridge waveguide. A second phase of the second electric field is rotated 90 degrees relative to the phase of the input electrical field when the input electrical field is applied to the first double-ridge waveguide. The second double-ridge waveguide is formed of a second electrically conductive material. The second double-ridge waveguide is configured to generate a third electric field with a polarization that is perpendicular to the first polarization. The polarization rotator is mounted between the first double-ridge waveguide and the second double-ridge waveguide and includes, but is not limited to, a frame, a dielectric layer, a first conducting pattern layer, a first switch, a second conducting pattern layer, and a second switch. The dielectric layer includes, but is not limited to, a first dielectric surface and a second dielectric surface formed within the frame. The first dielectric surface is on an opposite side of the dielectric layer relative to the second dielectric surface. The first dielectric surface is mounted adjacent an output side of the first double-ridge waveguide. The second dielectric surface is mounted adjacent an input side of the second double-ridge waveguide. The dielectric layer is formed of a dielectric material. The first conducting pattern layer is formed of a third electrically conductive material mounted to the first dielectric surface. The first conducting pattern layer includes, but is not limited to, a first conductor and a second conductor. The first switch is connected between the first conductor and the second conductor to electrically connect the first conductor to the second conductor or to electrically disconnect the first conductor from the second conductor. The second conducting pattern layer is formed of a fourth electrically conductive material mounted to the second dielectric surface. The second conducting pattern layer includes, but is not limited to, a third conductor and a fourth conductor. The second switch is connected between the third conductor and the fourth conductor to electrically connect the third conductor to the fourth conductor or to electrically disconnect the third conductor from the fourth conductor. When the first switch electrically connects the first conductor to the second conductor, the second switch electrically disconnects the third conductor from the fourth conductor to define a first mode of the polarization rotator. When the second switch electrically connects the third conductor to the fourth conductor, the first switch electrically disconnects the first conductor from the second conductor to define a second mode of the polarization rotator. The first mode is configured to rotate the first phase of the first electric field or the second phase of the second electric field by 90 degrees. The second mode is configured to rotate the first phase of the first electric field or the second phase of the second electric field by −90 degrees.

In another illustrative embodiment, a phased array antenna is provided. The phased array antenna includes, but is not limited to, a transmitter, a plurality of radiating antennas, and a plurality of waveguides. Each waveguide of the plurality of waveguides is mounted to receive electrical energy from the transmitter and to provide electrical energy to a respective radiating antenna of the plurality of radiating antennas.

Other principal features of the disclosed subject matter will become apparent to those skilled in the art upon review of the following drawings, the detailed description, and the appended claims.

BRIEF DESCRIPTION OF THE DRAWINGS

Illustrative embodiments of the disclosed subject matter will hereafter be described referring to the accompanying drawings, wherein like numerals denote like elements.

DETAILED DESCRIPTION

Figure 1:
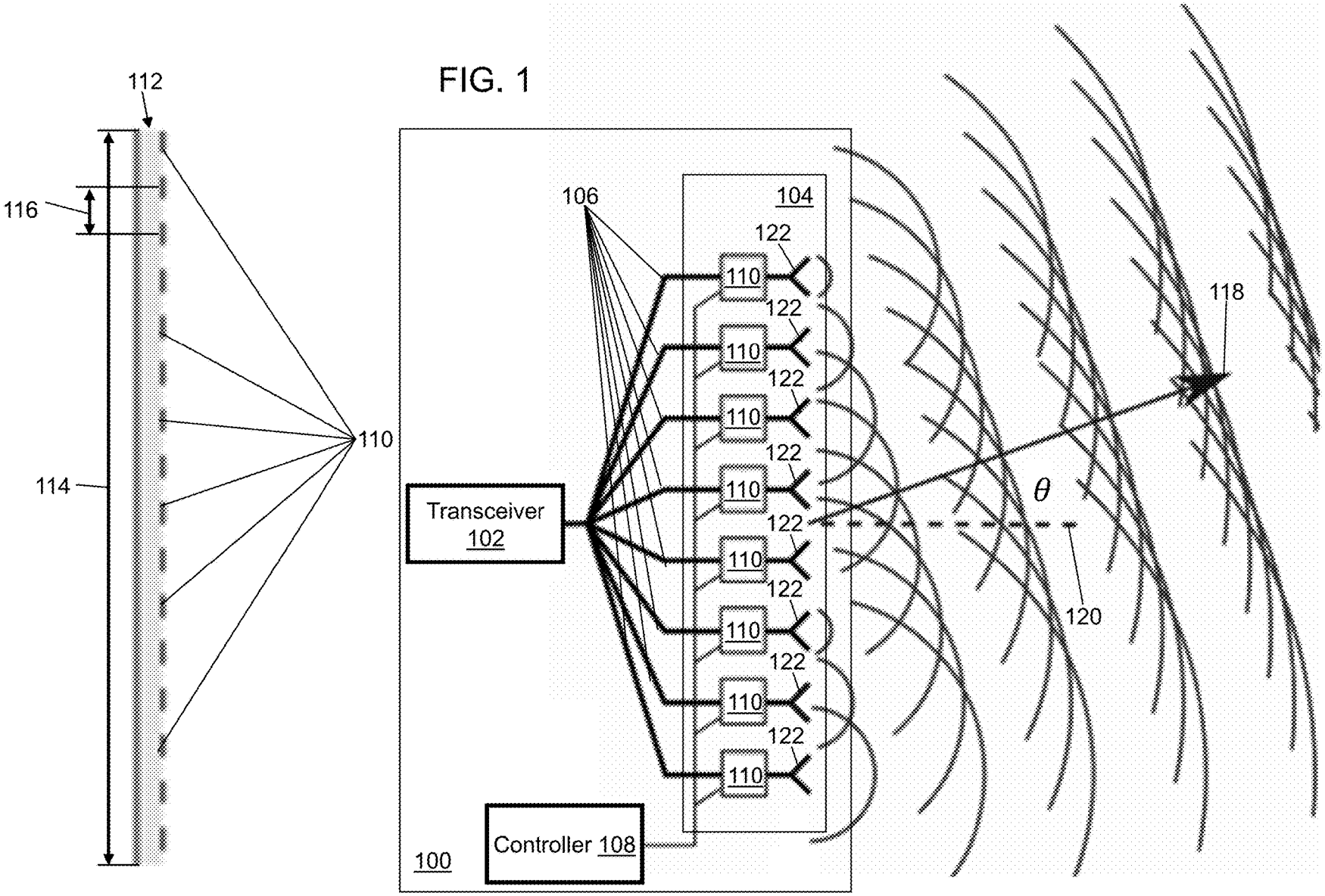
FIG. 1 depicts a side view of a transceiver system in accordance with an illustrative embodiment.

Referring to FIG. 1, a one-dimensional (1D) side view of a transceiver system 100 is shown in accordance with an illustrative embodiment. Transceiver system 100 may include a transceiver 102, a plurality of waveguides 104, a feed line network 106, and a controller 108. Transceiver system 100 may act as a transmitter and/or a receiver of analog or digital signals. Each waveguide of the plurality of waveguides 104 may include a phase-shifting waveguide 110 and a radiating antenna 122. For illustration, radiating antenna 122 may be implemented as a horn antenna though other antenna types may be used in alternative embodiments. Each phase-shifting waveguide 110 is connected to radiating antenna 122 that is a waveguide-to-free space transition section that couples energy from phase-shifting waveguide 110 to free space more efficiently.

The plurality of waveguides is arranged to form a phased array antenna 112. For example, a front of phased array antenna 112 may be arranged to form a 1D or a two-dimensional (2D) array of the plurality of waveguides 104. The plurality of waveguides 104 may form variously shaped apertures including circular, rectangular, square, elliptical, etc. The plurality of waveguides 104 can include any number of waveguides 110 connected to radiating antenna 122. Phased array antenna 112 has an aperture length 114 in a vertical plane and may further have a second aperture length (not shown) in a horizontal plane. A center of each radiating antenna 122 of the plurality of waveguides 104 may be separated a distance 116 from a center of each adjacent radiating antenna 122 in any direction.

Phased array antenna 112 can electronically change a pointing direction 118 of a main beam by changing a phase shift of electrical field output $E^{out}$ from each phase-shifting waveguide 110 relative to an electrical field input $E^{in}$ to each phase-shifting waveguide 110 under control of controller 108. Controller 108 thereby electronically steers the main beam to different directions without moving any of the plurality of waveguides 104 or phased array antenna 112. The electromagnetic energy associated with the electrical energy field input $E^{in}$ from transceiver 102 is fed to each phase-shifting waveguide 110 of the plurality of waveguides 104 through feed line network 106. Based on the pointing direction 118 of the main beam selected, controller 108 defines a phase shift value to be generated by each phase-shifting waveguide 110 of the plurality of waveguides 104. Each phase-shifting waveguide 110 provides 2-bit phase quantization as discussed further below so that each phase-shifting waveguide 110 acts as a 2-bit phase shifter.

With the phase relationship defined by controller 108 for each phase-shifting waveguide 110, the radio waves from each radiating antenna 122 connected to separate waveguides add together to increase the radiation in the pointing direction 118, while cancelling to suppress radiation in undesired directions. The lines from each radiating antenna 122 represent a wave front of the electromagnetic waves emitted by each radiating antenna 122. The individual wave fronts are spherical, but they combine in front of phased array antenna 112 to create a plane wave, a beam of radio waves travelling in the pointing direction 118. In the illustration of FIG. 1, a phase shift selected for each waveguide delays the waves progressively going up the aperture of phased array antenna 112 so that each radiating antenna 122 emits its wave front later than the one below it. The resulting plane wave is directed at the pointing direction 118 which is an angle θ measured relative to a boresight axis 120 of phased array antenna 112. By changing the phase shifts of each phase-shifting waveguide 110, controller can instantly change angle θ of the main beam. A 2D phased array can steer the main beam in two dimensions.

Transceiver system 100 may include a plurality of transceivers, and phased array antenna 112 may be organized into subarrays to support a plurality of main beams. For example, a distinct transceiver 102 may be associated with one or more waveguides 110 of the plurality of waveguides 104. Additionally, in alternative embodiments, transceiver 102 may only transmit or only receive.

Figure 2:
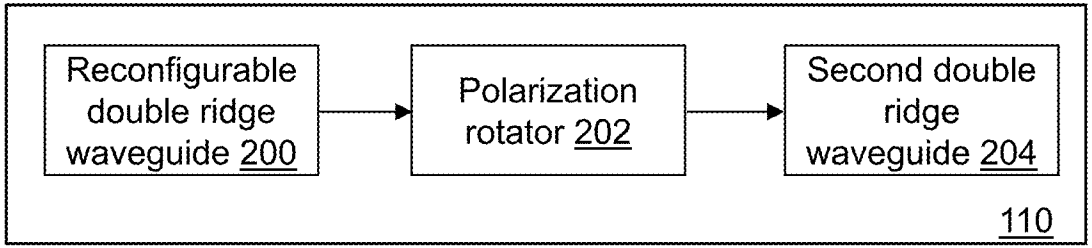
FIG. 2 depicts a block diagram of a phase-shifting waveguide in accordance with an illustrative embodiment.
Figure 3:
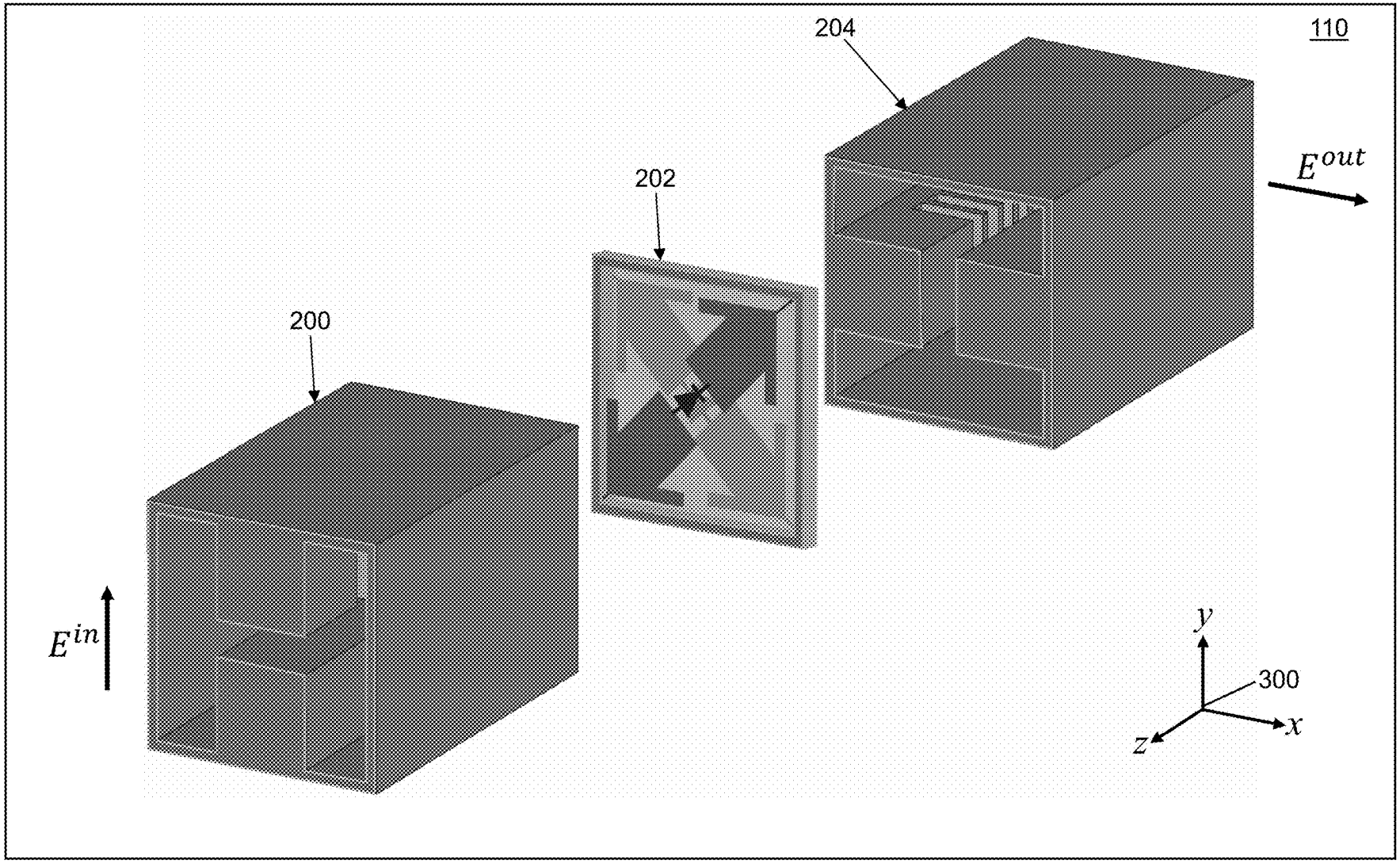
FIG. 3 depicts a perspective side view of a phase-shifting waveguide in accordance with an illustrative embodiment.

Referring to FIG. 2, a block diagram of phase-shifting waveguide 110 is shown in accordance with an illustrative embodiment. Referring to FIG. 3, a perspective side view of phase-shifting waveguide 110 is shown in accordance with an illustrative embodiment. phase-shifting waveguide 110 may include a reconfigurable double-ridge waveguide 200, a polarization rotator 202, and a second double-ridge waveguide 204. Reconfigurable double-ridge waveguide 200, polarization rotator 202, and second double-ridge waveguide 204 are mounted adjacent to each other in an axial direction with polarization rotator 202 between reconfigurable double-ridge waveguide 200 and second double-ridge waveguide 204. Each of reconfigurable double-ridge waveguide 200, polarization rotator 202, and second double-ridge waveguide 204 is formed of four walls arranged to form a hollow polygon such as a square or rectangle. phase-shifting waveguide 110 is a conduit with a frame formed of electrically conductive material used to confine and direct radio signals. Though in the illustrative embodiment, phase-shifting waveguide 110 is shown as having a square cross-sectional shape, a rectangular cross-sectional shape may be used in alternative embodiments.

Phase-shifting waveguide 110 is a direct-fed radiating element capable of providing wideband 2-bit phase quantization. Polarization rotator 202 can be placed into one of two operating states that rotate the polarization of a transmitted wave by +90° or by −90° with respect to that of an incident wave, creating two relative phase states of 0° and 180° for the transmitted wave. These two switchable phase states are combined with two phase shift values of 0° or of 90° generated by reconfigurable double-ridge waveguide 200 to produce four relative phase states of 0°, 90°, 180°, or 270° for the transmitted wave.

In the illustrative embodiment, reconfigurable double-ridge waveguide 200 is oriented in a vertical direction in an x-y plane because electrical field input $E^{in}$ is assumed to be vertically polarized, and second double-ridge waveguide 204 is oriented in a horizontal direction in the x-y plane because electrical field output $E^{out}$ will be horizontally polarized. In alternative embodiments, reconfigurable double-ridge waveguide 200 may be oriented in the horizontal direction, and second double-ridge waveguide 204 may be oriented in the vertical direction. The axial direction is parallel to a z-axis, where an x-axis is perpendicular to a y-axis, and both the x-axis and the y-axis are perpendicular to the z-axis to form a right-handed coordinate reference frame denoted x-y-z frame 300.

In the illustrative embodiment, two operating modes of reconfigurable double-ridge waveguide 200 generate relative phase shift values of 0° or 90°, when the phase shift provided by one of the two modes is taken as reference, to generate electrical field input to polarization rotator 202 designated $E^{inPR}$. In the illustrative embodiment, polarization rotator 202 provides either a 90° or a −90° of polarization rotation to $E^{inPR}$ to generate electrical field input to second double-ridge waveguide 204 designated $E^{inDWG}$. Second double-ridge waveguide 204 acts as a horizontal filter applied to $E^{inDWG}$ to generate electrical field output $E^{out}$ that is horizontally polarized with a phase shift of 0°, 90°, 180°, or 270° relative to the phase of electrical field output $E^{out}$ provided by one of the four operating modes. As a result, phase-shifting waveguide 110 can be configured to produce four relative phase states of 0°, 90°, 180°, or 270° for the transmitted wave.

Figure 4:
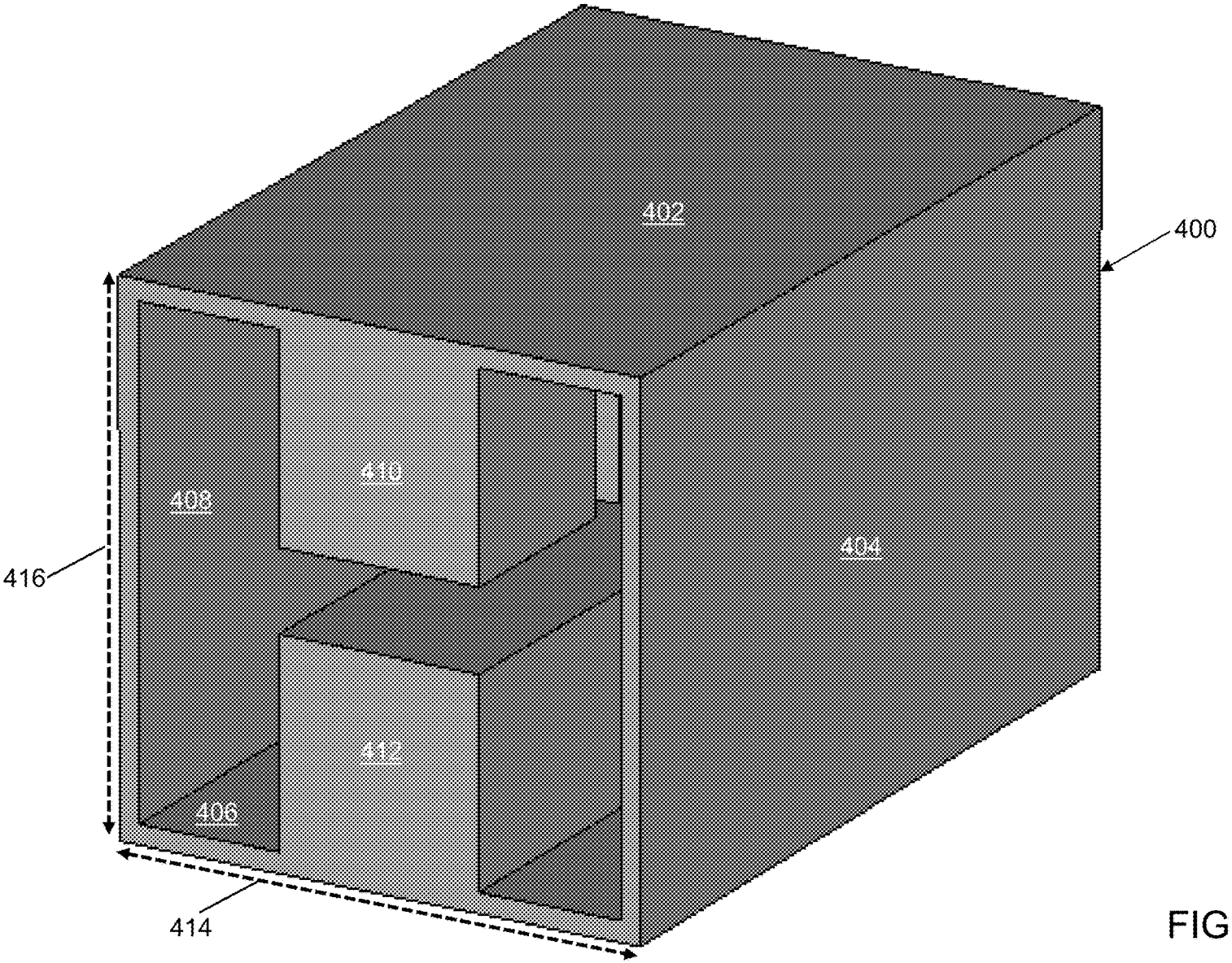
FIG. 4 depicts a perspective side view of a double-ridge waveguide of the waveguide of FIG. 3 in accordance with an illustrative embodiment.
Figure 5:
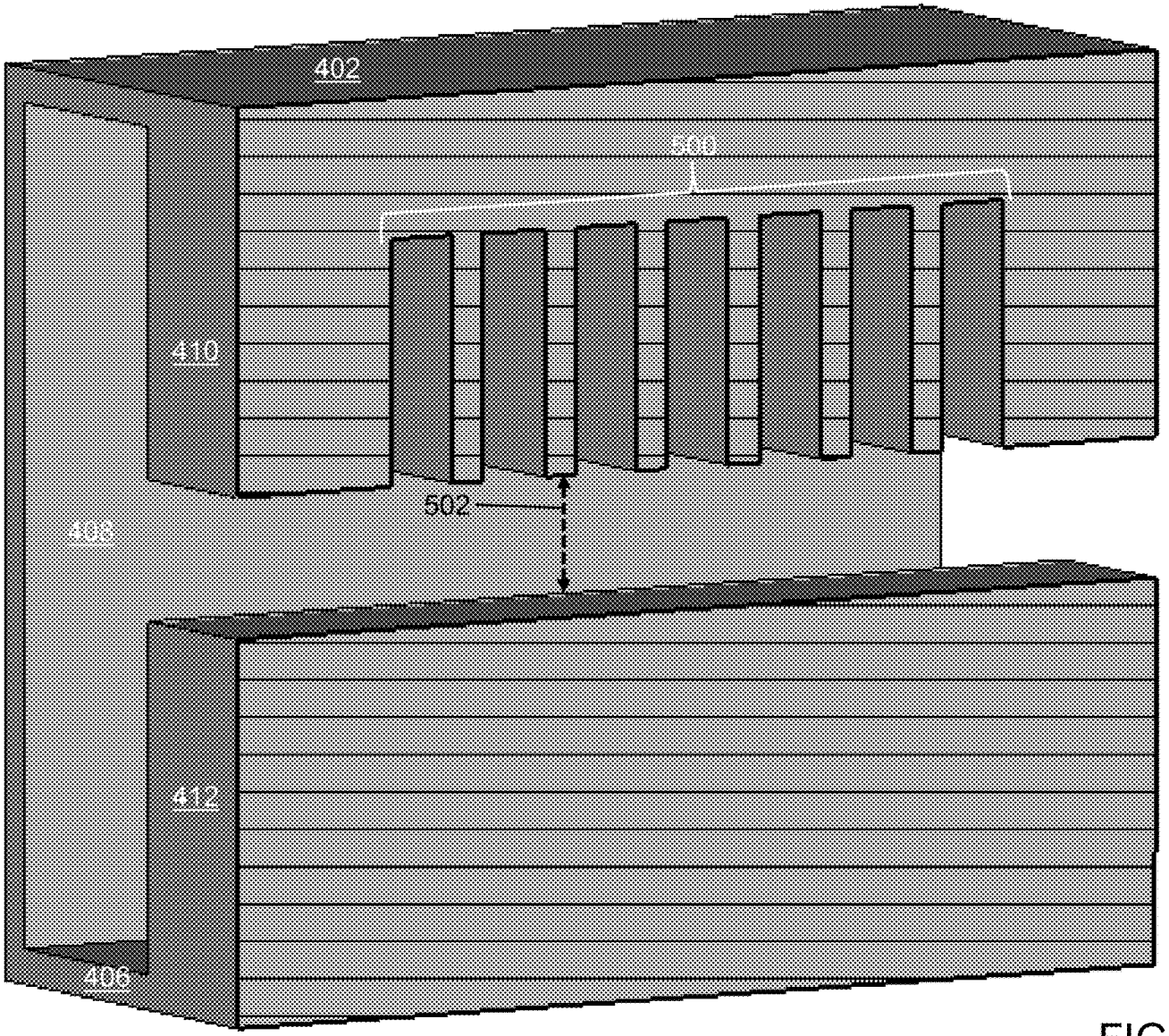
FIG. 5 depicts a perspective cross-sectional view of the double-ridge waveguide of FIG. 4 in accordance with an illustrative embodiment.
Figure 6:
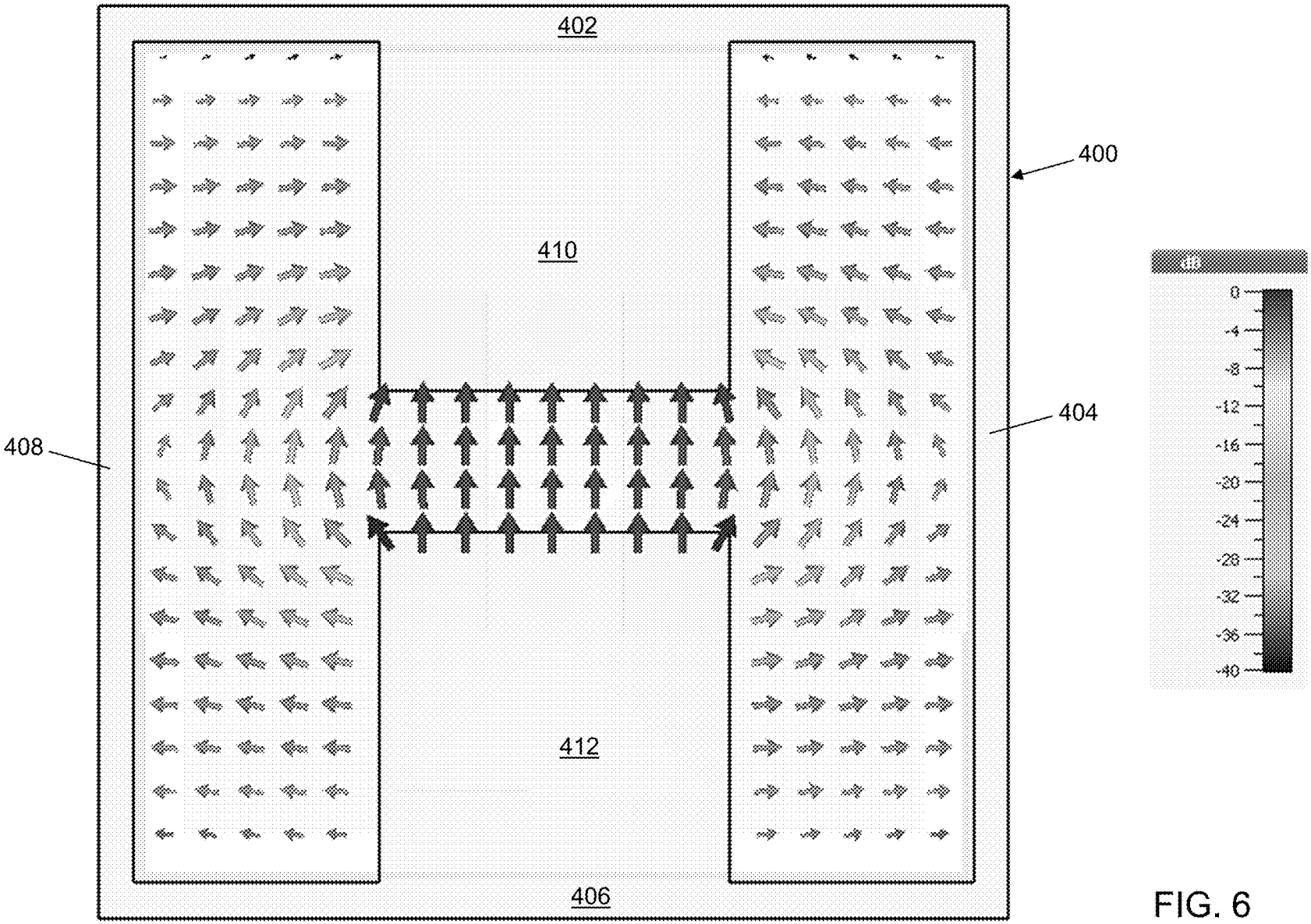
FIG. 6 depicts an electric field distribution of the double-ridge waveguide of FIG. 4 in accordance with an illustrative embodiment.

Referring to FIG. 4, a perspective side view of a double-ridge waveguide 400 is shown in accordance with an illustrative embodiment. Referring to FIG. 5, a perspective cross-sectional view of double-ridge waveguide 400 is shown in accordance with an illustrative embodiment. Referring to FIG. 6, an electric field distribution created by double-ridge waveguide 400 is shown in accordance with an illustrative embodiment. Both reconfigurable double-ridge waveguide 200 and second double-ridge waveguide 204 may be structured similar to double-ridge waveguide 400 though second double-ridge waveguide 204 is rotated 90° relative to double-ridge waveguide 400. Reconfigurable double-ridge waveguide 200 includes additional elements that make the output phase shift selectable between 0° or 90° as discussed further below.

Double-ridge waveguide 400 may include a top wall 402, a right side wall 404, a bottom wall 406, a left side wall 408, a first ridge 410, and a second ridge 412. A cross-section width 414 is defined as a width between right side wall 404 and left side wall 408. A cross-section height 416 is defined as a height between top wall 402 and bottom wall 406. Cross-section width 414 and cross-section height 416 may define cross-section dimensions of phase-shifting waveguide 110. A plurality of teeth 500 is formed in first ridge 410 that open toward second ridge 412. First ridge 410 and second ridge 412 reduce an internal height of double-ridge waveguide 400 in a horizontal direction or a vertical direction depending on the orientation of double-ridge waveguide 400. First ridge 410 and second ridge 412 extend a partial width or a partial height across double-ridge waveguide 400 with first ridge 410 and second ridge 412 separated by a gap having a predefined length 502. Dimensions for the walls of double-ridge waveguide 400, for the ridges, for the predefined length, for the plurality of teeth 500, etc. may be selected based on an upper operating frequency $f_u$ and a lower operating frequency $f_l$ of the electrical field input $E^{in}$ that defines corresponding wavelengths $$\lambda_u = \frac{c}{f_u} \text{ and } \lambda_l = \frac{c}{f_l},$$

where c is a speed of light. FIG. 6 shows the electric field distribution created by double-ridge waveguide 400 with the primary electrical field generated in a vertical direction between first ridge 410 and second ridge 412. A description of an illustrative structure for double-ridge waveguide 400 can be found in Balanis, Constantine A. Advanced, *Engineering Electromagnetics* 466-470 (2d ed. Wiley 2012).

Figure 8:
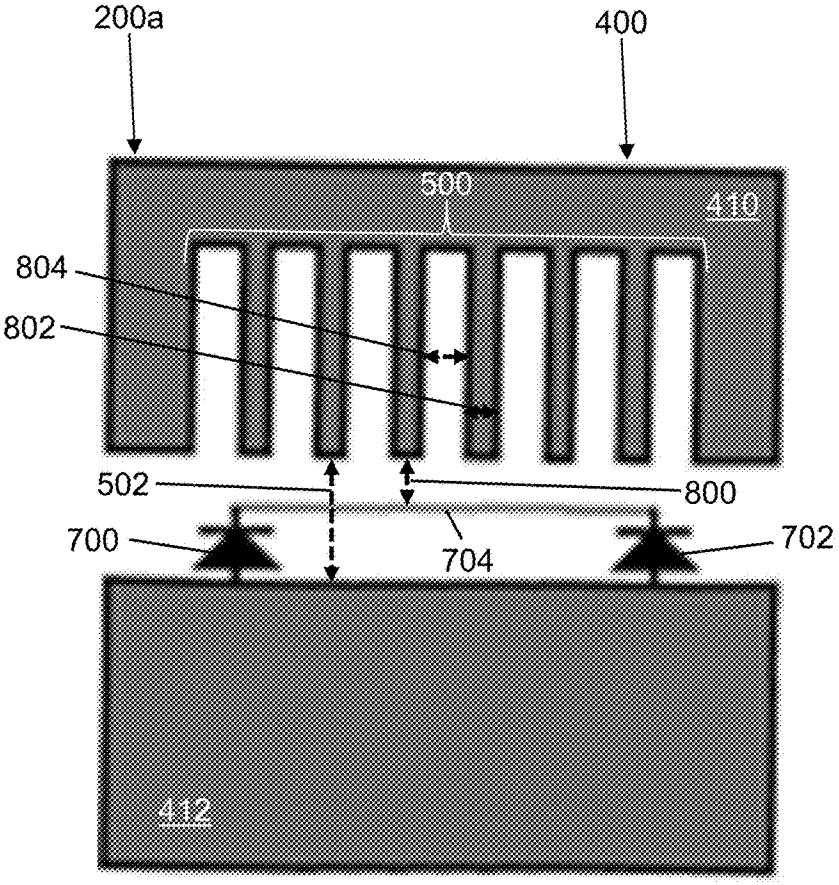
FIG. 8 depicts a side cross-sectional view of the reconfigurable double-ridge waveguide of FIG. 7 in accordance with the first illustrative embodiment.
Figure 7:
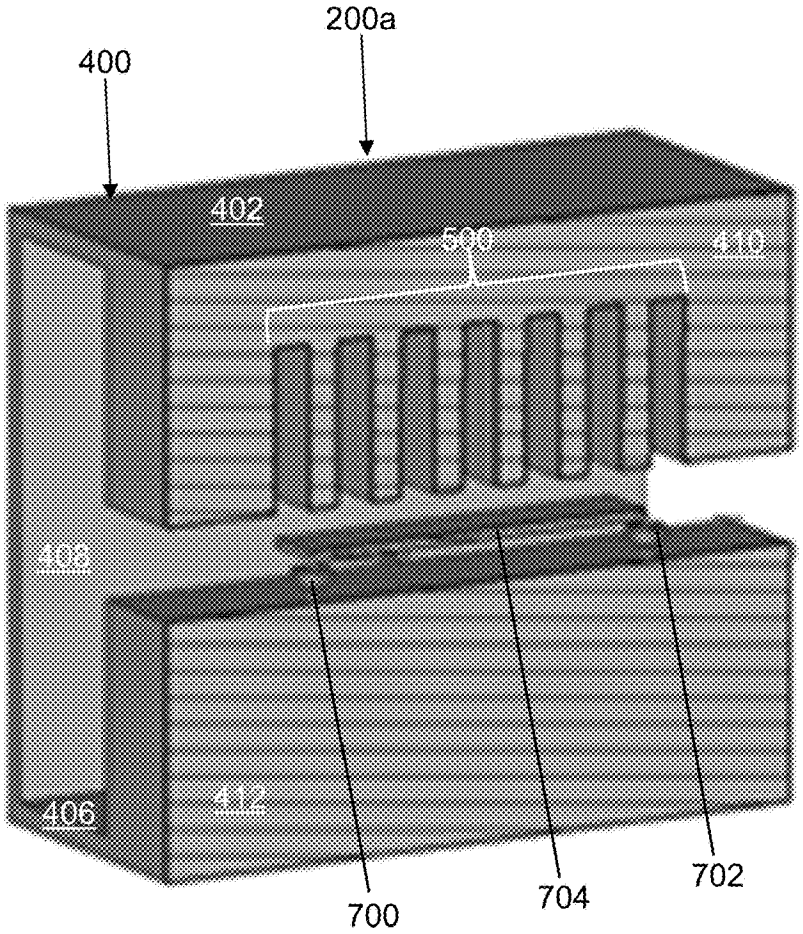
FIG. 7 depicts a perspective side view of a reconfigurable double-ridge waveguide of FIG. 4 in accordance with a first illustrative embodiment.

Referring to FIG. 7, a perspective side cross-sectional view of a first reconfigurable double-ridge waveguide 200*a* is shown in accordance with an illustrative embodiment. Referring to FIG. 8, a side cross-sectional view of first reconfigurable double-ridge waveguide 200*a* is shown in accordance with an illustrative embodiment. First reconfigurable double-ridge waveguide 200*a* may include double-ridge waveguide 400, a first diode 700, a second diode 702, and a plate 704. First diode 700 and second diode 702 are connected to controller 108 that selectively provides a first signal that causes a current to flow simultaneously through first diode 700 and through second diode 702 to plate 704 or provides a second signal that causes no current to flow through first diode 700 or second diode 702 to plate 704 thereby electrically isolating plate 704. As a result, the first signal electrifies plate 704 that is formed of an electrically conductive material such as a metal.

Electrification of plate 704 reduces predefined length 502 of the gap between first ridge 410 and second ridge 412 to a second predefined length 800. Second predefined length 800 is selected to generate the 90° phase shift relative to the phase of electrical field output $E^{out}$ provided when predefined length 502 is selected. In an alternative embodiment, second predefined length 800 may be selected to generate the −90° phase shift relative to the phase of electrical field output $E^{out}$ The first signal may be associated with a bit 0, and the second signal may be associated with a bit 1 though this is arbitrary. A ridge width 802 defines a width of each ridge of the plurality of teeth 500 and a gap between ridges 804 defines a width of a gap between each pair of ridged of the plurality of teeth 500.

The region between first ridge 410 and plate 704 connected to second ridge 412 forms a waveguide section. A phase velocity of a wave propagated in reconfigurable double-ridge waveguide 200*a* can be varied by changing a distance between first ridge 410 and second ridge 412. The wave travels faster in one state, for example, having the distance defined by second predefined length 800 and slower in the other state, for example, having the distance defined by predefined length 502. The different phase velocity provided by the two states results in a difference between the phases of the guided wave, for example, propagating from left to right, when the guided wave reaches to a right end of plate 704. A height of plate 704 or a difference defined by predefined length 502 minus second predefined length 800 determines the differences in the phase velocity between the two states. Varying the length of plate 704 and the plurality of teeth 500, which are selected to be the same, changes the amount of phase shift between the electric fields at the right end of plate 704 in two different states from 0 to 360 degrees. Therefore, a length of plate 704 that gives a phase shift of 90 degrees is chosen. The phase shift between the two modes can be either 90 or −90 degrees depending on the length of plate 704 though one option may result in a longer plate 704 than the other. For illustration, U.S. Pat. No. 4,725,795 that issued Feb. 16, 1988 describes a design of similar structures.

In an illustrative embodiment, first diode 700 and second diode 702 are PIN diodes that have a wide, undoped intrinsic semiconductor region between a p-type semiconductor and an n-type semiconductor region. The p-type and n-type regions are typically heavily doped for use as ohmic contacts to provide fast switching. In alternative embodiments, first diode 700 and second diode 702 may be replaced with any single pole, single throw (SPST) switch device or other electrical structure that acts as an SPST switch device. For example, the SPST switch device may be a mechanical switch, a microelectromechanical system (MEMS) switch, a commercially available SPST switch, one or more PIN diodes, etc. Each of first diode 700 and second diode 702 form switchable connections that have two states: short referred to as a conducting position, and open referred to as a non-conducting position.

Figure 10:
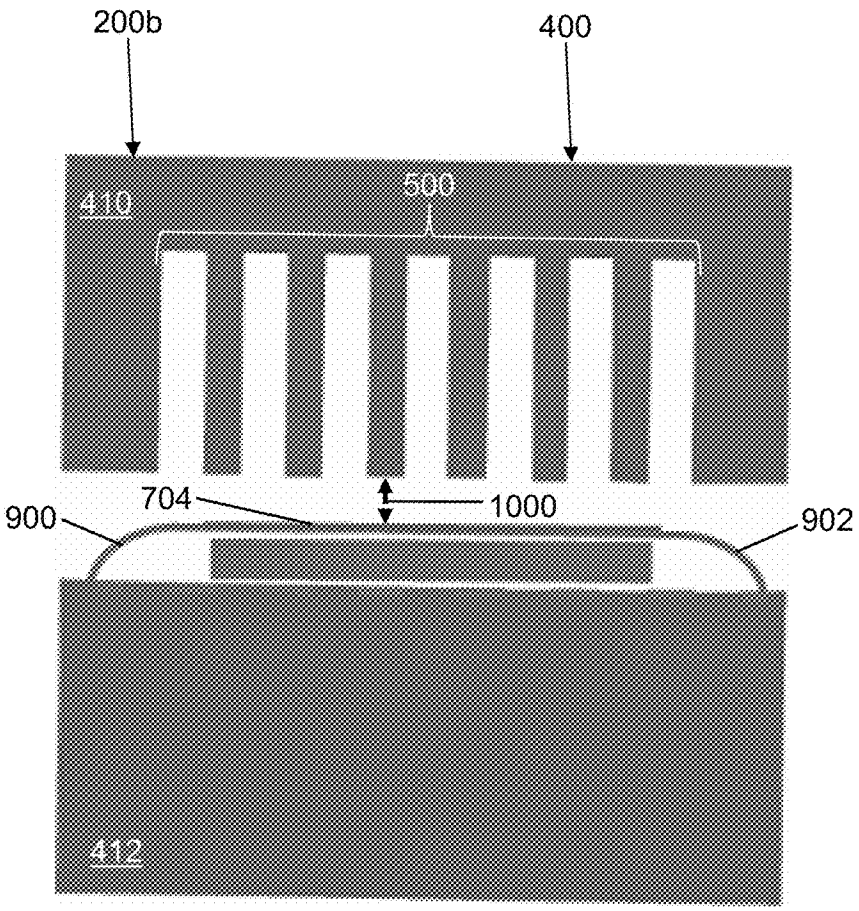
FIG. 10 depicts a side cross-sectional view of the reconfigurable double-ridge waveguide of FIG. 9 in accordance with the second illustrative embodiment.
Figure 9:
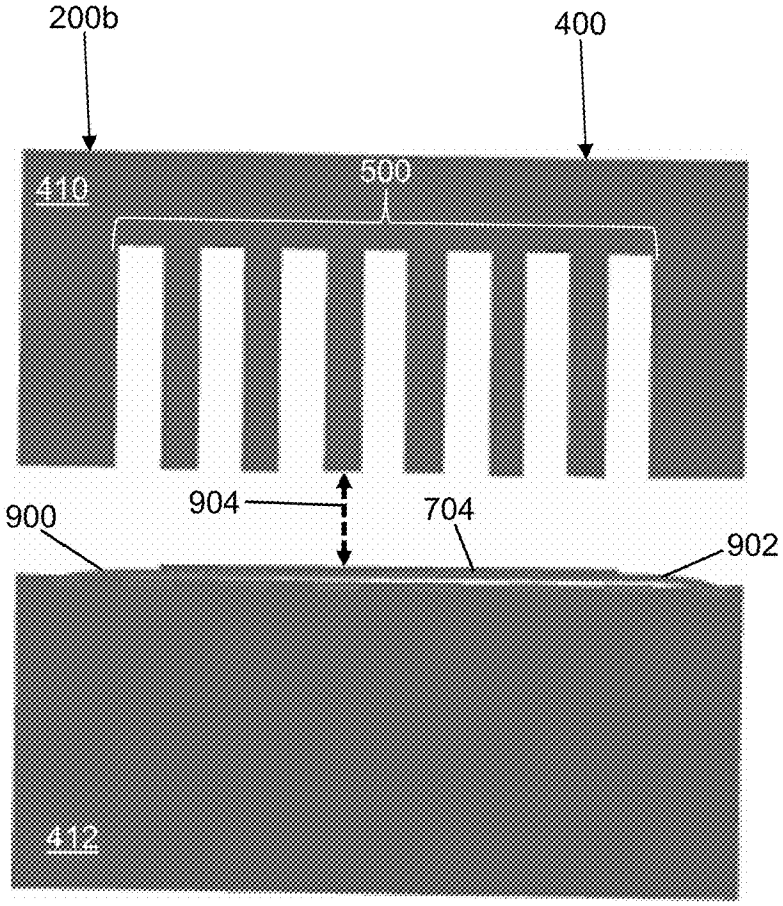
FIG. 9 depicts a perspective side view of a reconfigurable double-ridge waveguide of FIG. 4 in accordance with a second illustrative embodiment.

Referring to FIG. 9, a side cross-sectional view of a second reconfigurable double-ridge waveguide 200*b* in a first position is shown in accordance with an illustrative embodiment. Referring to FIG. 10, a side cross-sectional view of second reconfigurable double-ridge waveguide 200*b* in a second position is shown in accordance with an illustrative embodiment. Second reconfigurable double-ridge waveguide 200*b* may include double-ridge waveguide 400, a first actuator 900, a second actuator 902, and plate 704. First actuator 900 and second actuator 902 are connected to and controlled by controller 108 that selectively provides a first signal that moves plate 704 to the first position where plate 704 is separated from second ridge 412 by a third predefined length 904 or provides a second signal that moves plate 704 to the second position where plate 704 is separated from second ridge 412 by a fourth predefined length 1000. Third predefined length 904 is selected to generate the 90° phase shift relative to the phase provided when fourth predefined length 1000 is selected. In an alternative embodiment, third predefined length 904 may be selected to generate the −90° phase shift relative to the phase provided when fourth predefined length 1000 is selected. The first signal may be associated with a bit 0, and the second signal may be associated with a bit 1 though this is arbitrary.

Figure 11A:
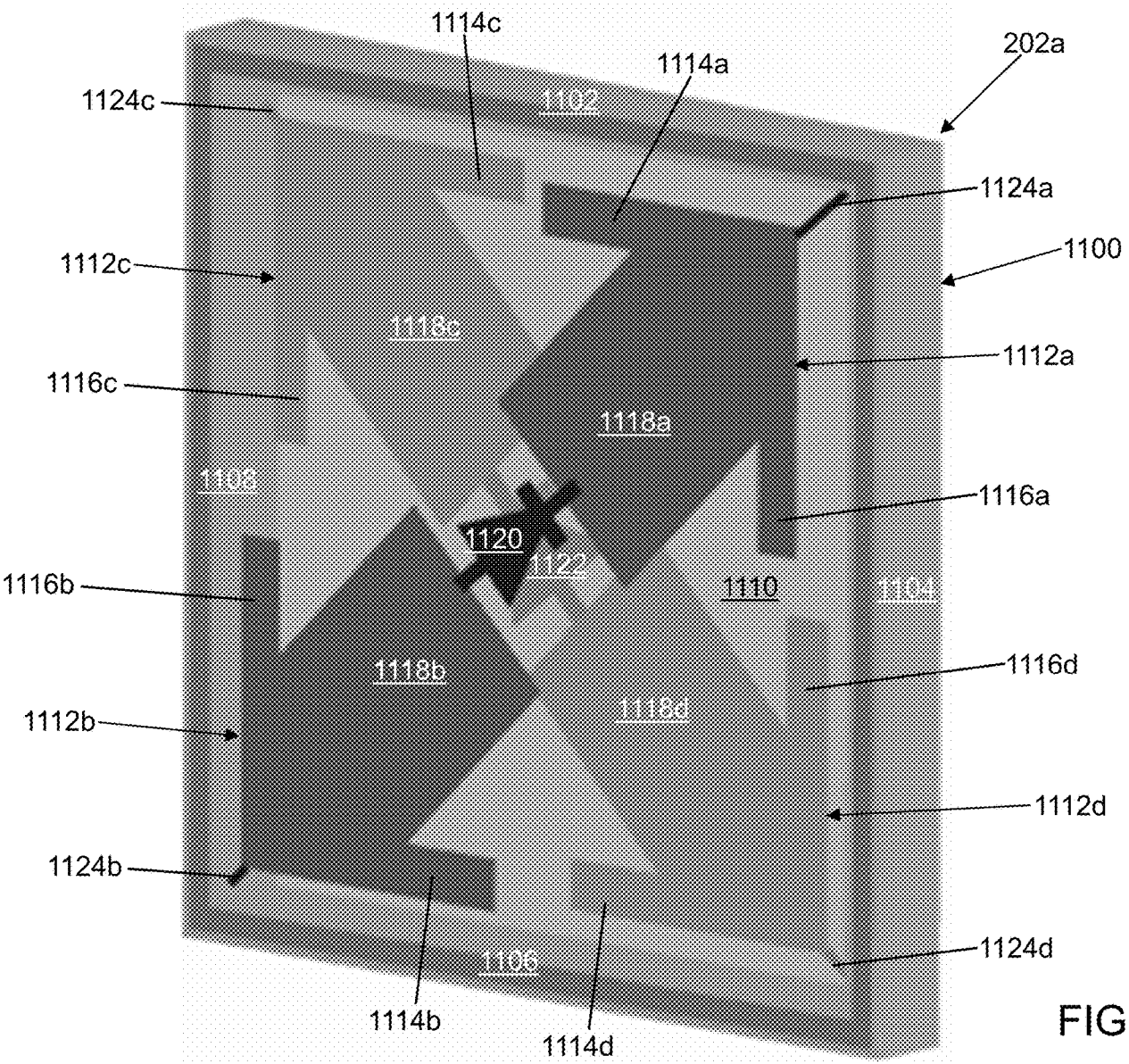
FIG. 11A depicts a perspective side view of a polarization rotator of the waveguide of FIG. 3 in accordance with a first illustrative embodiment.

Referring to FIG. 11A, a perspective side view of a first polarization rotator 202*a* is shown in accordance with an illustrative embodiment. First polarization rotator 202*a* may include a rotator top wall 1102, a rotator right side wall 1104, a rotator bottom wall 1106, a rotator left side wall 1108, a dielectric layer 1110, a first corner conductor 1112*a*, a second corner conductor 1112*b*, a third corner conductor 1112*c*, a fourth corner conductor 1112*d*, a first rotator diode 1120, a second rotator diode 1122, a first bias line 1124*a*, a second bias line 1124*b*, a third bias line 1124*c*, and a fourth bias line 1124*d*. Rotator top wall 1102, rotator right side wall 1104, rotator bottom wall 1106, and rotator left side wall 1108 define a frame for first polarization rotator 202*a* that is square in the illustrative embodiment with a width and a height that are similar to those selected for reconfigurable double-ridge waveguide 200 and second double-ridge waveguide 204.

Dielectric layer 1110 is formed of a dielectric material that extends between rotator top wall 1102, rotator right side wall 1104, rotator bottom wall 1106, and rotator left side wall 1108. Dielectric layer 1110 may be formed of one or more dielectric materials that may include foamed polyethylene, solid polyethylene, polyethylene foam, polytetrafluoroethylene, air, air space polyethylene, vacuum, etc. Illustrative dielectric materials include RO4003C laminate and RO3006 laminate sold by Rogers Corporation headquartered in Chandler, Ariz., USA.

First polarization rotator 202*a* behaves like an inductor. A size and substrate selection for first polarization rotator 202*a* affects the inductance. The width and length of first polarization rotator 202*a* may be selected based on a dielectric constant and thickness of dielectric layer 1110 to provide a desired inductance value.

First corner conductor 1112*a* and second corner conductor 1112*b* are formed on a left surface of dielectric layer 1110 and define a first conducting pattern layer, and third corner conductor 1112*c* and fourth corner conductor 1112*d* are formed on a right surface of dielectric layer 1110 opposite left surface of dielectric layer 1110 define a second conducting pattern layer. First corner conductor 1112*a*, second corner conductor 1112*b*, third corner conductor 1112*c*, and fourth corner conductor 1112*d* can have any crossed-dipole shape.

First corner conductor 1112*a*, second corner conductor 1112*b*, third corner conductor 1112*c*, and fourth corner conductor 1112*d* are formed of an electrically conductive material such as copper plated steel, silver plated steel, silver plated copper, silver plated copper clad steel, copper, copper clad aluminum, steel, etc. First corner conductor 1112*a*, second corner conductor 1112*b*, third corner conductor 1112*c*, and fourth corner conductor 1112*d* may be generally flat or formed of ridges or bumps. For illustration, first corner conductor 1112*a*, second corner conductor 1112*b*, third corner conductor 1112*c*, and fourth corner conductor 1112*d* may be formed of flexible membranes coated with a conductor. The left surface is mounted adjacent an input side of reconfigurable double-ridge waveguide 200, and the right surface is mounted adjacent an output side of second double-ridge waveguide 204 in the illustrative orientations shown.

In the illustrative embodiment, first corner conductor 1124*a*, second corner conductor 1124*b*, third corner conductor 1124*c*, and fourth corner conductor 1124*d* each form an open arrow shape with arrow tip arms separated by 90 degrees and each arrow tip pointed at 45°, 225°, 135°, and 315° respectively, in the x-y plane and relative to the +x-direction. Thus, a tip of each open arrow shape is pointed in a direction that is rotated 90° relative to each adjacent tip. Additionally, first corner conductor 1124*a* and second corner conductor 1124*b* are rotated 180° from each other, and third corner conductor 1124*c* and fourth corner conductor 1124*d* are rotated 180° from each other. First corner conductor 1124*a*, second corner conductor 1124*b*, third corner conductor 1124*c*, and fourth corner conductor 1124*d* are symmetrically distributed relative to each corner of dielectric layer 1110 and have the identical shape and size.

First corner conductor 1124*a* is positioned in an upper right quadrant of the left surface of dielectric layer 1110. First corner conductor 1124*a* includes a first connecting arm 1118*a*, a first x-arm 1114*a*, and a first y-arm 1116*a*. First x-arm 1114*a* and first y-arm 1116*a* are perpendicular to each other and parallel to the x-axis and the y-axis, respectively. First connecting arm 1118*a* is parallel to a diagonal axis that extends between the upper right corner and the lower left corner formed by rotator top wall 1102, rotator right side wall 1104, rotator bottom wall 1106, and rotator left side wall 1108. First x-arm 1114*a* and first y-arm 1116*a* are joined to form the arrowhead shape in the upper right corner of first polarization rotator 202*a*, and first connecting arm 1118*a* is joined to first x-arm 1114*a* and first y-arm 1116*a* to form the shaft that extends from the arrowhead shape toward a center of the left surface. As a result, first connecting arm 1118*a* is aligned with and extends from the tip formed at the intersection of first x-arm 1114*a* and first y-arm 1116*a*. First connecting arm 1118*a*, first x-arm 1114*a*, and first y-arm 1116*a* are used to describe a shape of first corner conductor 1124*a* and typically are not distinct elements but form a single conductive structure. For simplicity of description, first x-arm 1114*a*, first y-arm 1116*a*, and first connecting arm 1118*a* have been described to overlap near the upper right corner though again first connecting arm 1118*a*, first x-arm 1114*a*, and first y-arm 1116*a* typically are not distinct elements, but form a single conductive structure.

Second corner conductor 1124*b* is positioned in a lower left quadrant of the left surface of dielectric layer 1110. Second corner conductor 1124*b* includes a second connecting arm 1118*b*, a second x-arm 1114*b*, and a second y-arm 1116*b*. Second x-arm 1114*b* and second y-arm 1116*b* are perpendicular to each other and parallel to the x-axis and the y-axis, respectively. Second connecting arm 1118*b* is parallel to the diagonal axis that extends between the upper right corner and the lower left corner formed by rotator top wall 1102, rotator right side wall 1104, rotator bottom wall 1106, and rotator left side wall 1108. Second x-arm 1114*b* and second y-arm 1116*b* are joined to form the arrowhead shape in the lower left corner of first polarization rotator 202*a*, and second connecting arm 1118*b* is joined to second x-arm 1114*b* and second y-arm 1116*b* to form the shaft that extends from the arrowhead shape toward the center of the left surface. As a result, second connecting arm 1118*b* is aligned with and extends from the tip formed at the intersection of second x-arm 1114*b* and second y-arm 1116*b*. Second connecting arm 1118*b*, second x-arm 1114*b*, and second y-arm 1116*b* are used to describe a shape of second corner conductor 1124*b* and typically are not distinct elements but form a single conductive structure. For simplicity of description, second x-arm 1114*b*, second y-arm 1116*b*, and second connecting arm 1118*b* have been described to overlap near the lower left corner though again second connecting arm 1118*b*, second x-arm 1114*b*, and second y-arm 1116*b* typically are not distinct elements, but form a single conductive structure.

Third corner conductor 1124*c* is positioned in an upper left quadrant of the right surface of dielectric layer 1110. Third corner conductor 1124*c* includes a third connecting arm 1118*c*, a third x-arm 1114*c*, and a third y-arm 1116*c*. Third x-arm 1114*c* and third y-arm 1116*c* are perpendicular to each other and parallel to the x-axis and the y-axis, respectively. Third connecting arm 1118*c* is parallel to the diagonal axis that extends between the upper left corner and the lower right corner formed by rotator top wall 1102, rotator right side wall 1104, rotator bottom wall 1106, and rotator left side wall 1108. Third x-arm 1114*c* and third y-arm 1116*c* are joined to form the arrowhead shape in the upper left corner of first polarization rotator 202*a*, and third connecting arm 1118*c* is joined to third x-arm 1114*c* and third y-arm 1116*c* to form the shaft that extends from the arrowhead shape toward the center of the right surface. As a result, third connecting arm 1118*c* is aligned with and extends from the tip formed at the intersection of third x-arm 1114*c* and third y-arm 1116*c*. Third connecting arm 1118*c*, third x-arm 1114*c*, and third y-arm 1116*c* are used to describe a shape of third corner conductor 1124*c* and typically are not distinct elements but form a single conductive structure. For simplicity of description, third x-arm 1114*c*, third y-arm 1116*c*, and third connecting arm 1118*c* have been described to overlap near the upper left corner though again third connecting arm 1118*c*, third x-arm 1114*c*, and third y-arm 1116*c* typically are not distinct elements, but form a single conductive structure.

Fourth corner conductor 1124*d* is positioned in a lower right quadrant of the right surface of dielectric layer 1110. Fourth corner conductor 1124*d* includes a fourth connecting arm 1118*d*, a fourth x-arm 1114*d*, and a fourth y-arm 1116*d*. Fourth x-arm 1114*d* and fourth y-arm 1116*d* are perpendicular to each other and parallel to the x-axis and the y-axis, respectively. Fourth connecting arm 1118*d* is parallel to the diagonal axis that extends between the upper left corner and the lower right corner formed by rotator top wall 1102, rotator right side wall 1104, rotator bottom wall 1106, and rotator left side wall 1108. Fourth x-arm 1114*d* and fourth y-arm 1116*d* are joined to form the arrowhead shape in the lower right corner of first polarization rotator 202*a*, and fourth connecting arm 1118*d* is joined to fourth x-arm 1114*d* and fourth y-arm 1116*d* to form the shaft that extends from the arrowhead shape toward the center of the right surface. As a result, fourth connecting arm 1118*d* is aligned with and extends from the tip formed at the intersection of fourth x-arm 1114*d* and fourth y-arm 1116*d*. Fourth connecting arm 1118*d*, fourth x-arm 1114*d*, and fourth y-arm 1116*d* are used to describe a shape of fourth corner conductor 1124*d* and typically are not distinct elements but form a single conductive structure. For simplicity of description, fourth x-arm 1114*d*, fourth y-arm 1116*d*, and fourth connecting arm 1118*d* have been described to overlap near lower left corner 142 though again fourth connecting arm 1118*d*, fourth x-arm 1114*d*, and fourth y-arm 1116*d* typically are not distinct elements, but form a single conductive structure.

Inclusion of first x-arms 1114*a*, 1114*b*, 1114*c*, 1114*d* perpendicular to first y-arms 1116*a*, 1116*b*, 1116*c*, 1116*d*, respectively, allows phase-shifting waveguide 110 to support polarizations parallel to the x-axis as well as the y-axis.

In an illustrative embodiment, first rotator diode 1120 and second rotator diode 1122 are PIN diodes that provide fast switching. In alternative embodiments, first rotator diode 1120 and second rotator diode 1122 may be replaced with any SPST switch device or other electrical structure that acts as an SPST switch device. Each of first rotator diode 1120 and second rotator diode 1122 form switchable connections that have two states: short referred to as a conducting position, and open referred to as a non-conducting position.

First rotator diode 1120 is connected between a first edge of first connecting arm 1118*a* closest to the center of the left surface and a second edge of second connecting arm 1118*b* closest to the center of the left surface. First bias line 1124*a* is connected to the first tip of first corner conductor 1112*a* at the upper right corner of the left surface of first polarization rotator 202*a*. Second bias line 1124*b* is connected to the second tip of second corner conductor 1112*b* at the lower left corner of the left surface of first polarization rotator 202*a*. Second bias line 1124*b*, second connecting arm 1118*b*, first rotator diode 1120, first connecting arm 1118*a*, and first bias line 1124*a* form an electrical circuit. First bias line 1124*a* and second bias line 1124*b*, one of which may be electrically connected to a wall of first polarization rotator 202*a*, are used to control the bias state of first rotator diode 1120. The two connecting arms 1118*a* and 1118*b* are electrically connected when first rotator diode 1120 is forward biased and electrically isolated when first rotator diode 1120 is reverse biased. The geometrical orientation of first rotator diode 1120 is not important because radio frequency alternating currents can flow to first rotator diode 1120 either way.

Second rotator diode 1122 is connected between a third edge of third connecting arm 1118*c* closest to the center of the right surface and a fourth edge of fourth connecting arm 1118*d* closest to the center of the right surface. Third bias line 1124*c* is connected to the third tip of third corner conductor 1112*c* at the upper left corner of the right surface of first polarization rotator 202*a*. Fourth bias line 1124*d* is connected to the fourth tip of fourth corner conductor 1112*d* at the lower right corner of the right surface of first polarization rotator 202*a*. Third bias line 1124*c*, third connecting arm 1118*c*, second rotator diode 1122, fourth connecting arm 1118*d*, and fourth bias line 1124*d* form an electrical circuit. Third bias line 1124*c* and fourth bias line 1124*d*, one of which may be electrically connected to a wall of first polarization rotator 202*a*, are used to control the bias state of second rotator diode 1122. The two connecting arms 1118*c* and 1118*d* are electrically connected when second rotator diode 1122 is forward biased and electrically isolated when second rotator diode 1122 is reverse biased. The geometrical orientation of second rotator diode 1122 is not important because radio frequency alternating currents can flow to second rotator diode 1122 either way.

An electrical path length of first connecting arm 1118*a*, of second connecting arm 1118*b*, of third connecting arm 1118*c*, and of fourth connecting arm 1118*d* is approximately $\lambda_0/4$ (a quarter of the wavelength), where $\lambda_0$ is the wavelength in free space at the frequency of operation. A combined electrical path length of third bias line 1124*c*, second rotator diode 1122, and fourth bias line 1124*d* and of second bias line 1124*b*, first rotator diode 1120, and first bias line 1124*a* may be in the range from $\lambda_0/100$ to $\lambda_0/5$. A combined electrical path length of second bias line 1124*b*, second connecting arm 1118*b*, first rotator diode 1120, first connecting arm 1118*a*, and first bias line 1124*a* is approximately $\lambda_0/2$ (a half of the wavelength), where $\lambda_0$ is the wavelength in free space at the frequency of operation. Similarly, a combined electrical path length of third bias line 1124*c*, third connecting arm 1118*c*, second rotator diode 1122, fourth connecting arm 1118*d*, and fourth bias line 1124*d* is approximately $\lambda_0/2$.

First bias line 1124*a*, second bias line 1124*b*, third bias line 1124*c*, and fourth bias line 1124*d* are connected to controller 108 that selectively provides a third direct current signal that puts first rotator diode 1120 in forward bias and second rotator diode 1122 in reverse bias or provides a fourth signal that puts second rotator diode 1122 in forward bias and first rotator diode 1120 in reverse bias. Application of the third signal allows strong induced electrical currents to flow on second connecting arm 1118*b* and first connecting arm 1118*a* along the diagonal axis that extends between the lower left corner and the upper right corner formed by rotator top wall 1102, rotator right side wall 1104, rotator bottom wall 1106, and rotator left side wall 1108 of polarization rotator 202 when it is illuminated with an x-polarized or y-polarized wave from reconfigurable double-ridge waveguide 200. As a result, the polarization of the $E^{inDWG}$ is rotated by 90° with respect to $E^{inPR}$. Application of the fourth signal allows strong induced electrical currents to flow on fourth connecting arm 1118*d* and third connecting arm 1118*c* along the diagonal axis that extends between the lower right corner and the upper left corner formed by rotator top wall 1102, rotator right side wall 1104, rotator bottom wall 1106, and rotator left side wall 1108 of polarization rotator 202 when it is illuminated with an x-polarized or y-polarized wave from reconfigurable double-ridge waveguide 200. As a result, the polarization of the $E^{inDWG}$ is rotated by −90° with respect to $E^{inPR}$.

Figure 11B:
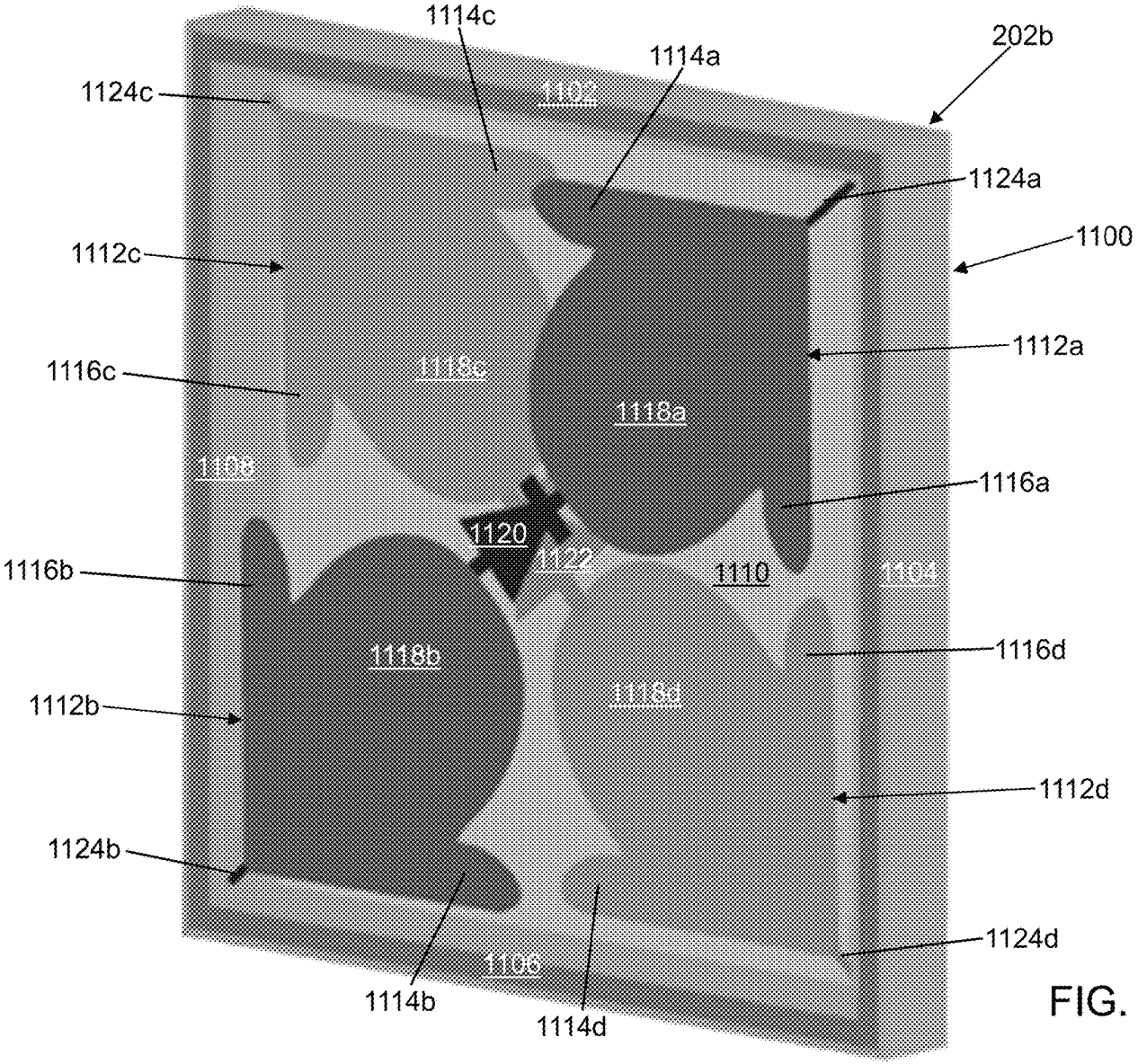
FIG. 11B depicts a perspective side view of a polarization rotator of the waveguide of FIG. 3 in accordance with a second illustrative embodiment.

Referring to FIG. 11B, a perspective side view is shown of a second polarization rotator 202*b* is shown in accordance with a second illustrative embodiment. First corner conductor 1124*a*, second corner conductor 1124*b*, third corner conductor 1124*c*, and fourth corner conductor 1124*d* of first polarization rotator 202*a* have straight edges. First corner conductor 1124*a*, second corner conductor 1124*b*, third corner conductor 1124*c*, and fourth corner conductor 1124*d* of second polarization rotator 202*b* include curved edges.

Figure 12:
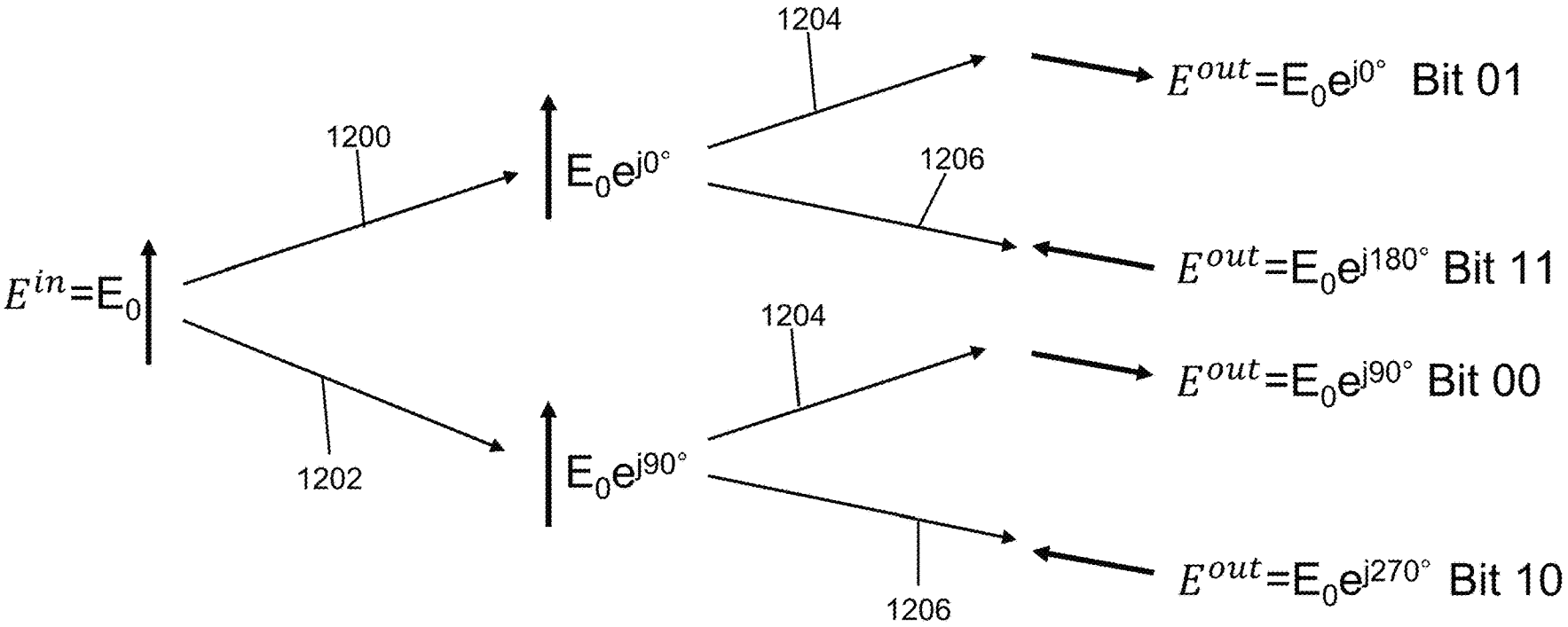
FIG. 12 illustrates an input electrical field and a corresponding output electric field generated based on an operating mode of the reconfigurable double-ridge waveguide of FIGS. 7 and 9 and of the polarization rotator of FIG. 11A in accordance with an illustrative embodiment.

Referring to FIG. 12, an input electrical field and a corresponding output electric field are shown that were generated based on an operating mode of first reconfigurable double-ridge waveguide 200*a* and of polarization rotator 202*a* in accordance with an illustrative embodiment. The table below shows an illustrative bit configuration generated based on the options discussed above:

| First diode 700/plate 704 position | Second diode 702/plate 704 position | First rotator diode 1120 | Second rotator diode 1122 | Bit state | Relative phases of $E^{out}$ |
|---|---|---|---|---|---|
| OFF/DOWN | OFF/DOWN | ON | OFF | 00 | 90° |
| ON/UP | ON/UP | ON | OFF | 01 | 0° |
| OFF/DOWN | OFF/DOWN | OFF | ON | 10 | −90° |
| ON/UP | ON/UP | OFF | ON | 11 | 180° |

Of course, the bit configurations can be defined in other manners to distinguish the four operating states of phase-shifting waveguide 110. A first phasor 1200 is generated by the first signal, and a second phasor 1202 is generated by the second signal. A third phasor 12044 is generated by the third signal, and a fourth phasor 1206 is generated by the fourth signal. Second double-ridge waveguide 204 provides a horizontal polarization to generate electrical field output $E^{out}$ that is horizontally polarized with the resulting phase shift of 0°, 90°, 180°, or 270° relative to the phase of electrical field input $E^{in}$.

Figure 13:
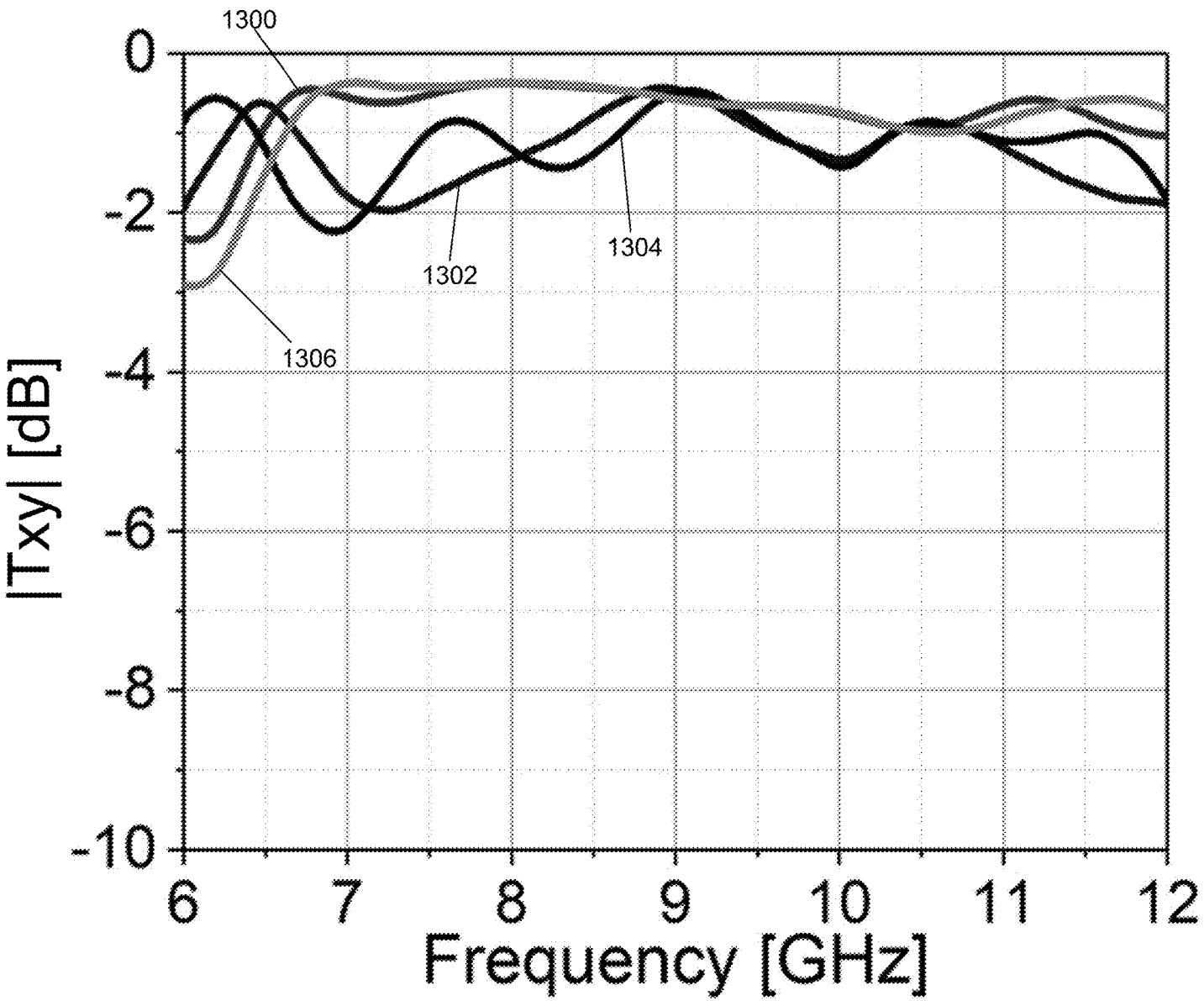
FIG. 13 depicts magnitudes of simulated x-y transmission coefficients corresponding to four operating modes of the waveguide of FIG. 3 as a function of frequency in accordance with an illustrative embodiment.

Referring to FIG. 13, a simulated x-y transmission coefficient is shown that was generated by phase-shifting waveguide 110 as a function of frequency in accordance with an illustrative embodiment. The simulated phase-shifting waveguide 110 was based on aluminum material. Cross-section width 414 and cross-section height 416 of phase-shifting waveguide 110 were 12 millimeters (mm)×12 mm. Ridge width 802 and gap between ridges 804 were 5 mm and 2 mm, respectively. 0.254 mm RO4003C with a dielectric constant of 3.55 and a loss tangent of 0.0027 was used for polarization rotator 202. First predefined length 502 and third predefined length 904 were 2 mm, and second predefined length 800 and fourth predefined length 1000 were 0.8 mm for the two different states of reconfigurable double-ridge waveguide 200.

Figure 14:
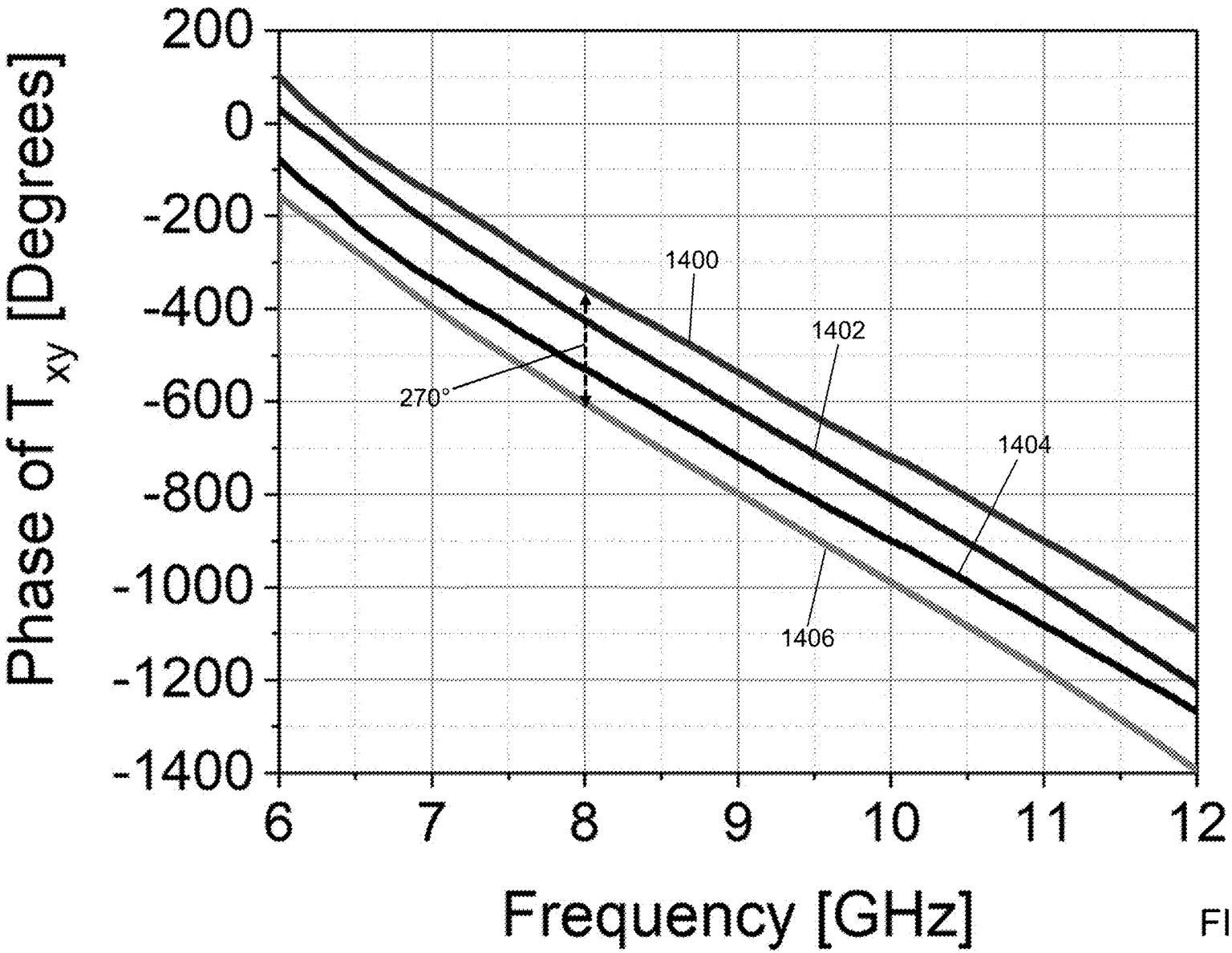
FIG. 14 depicts phases of simulated x-y transmission coefficients corresponding to four operating modes of the waveguide of FIG. 3 as a function of frequency in accordance with an illustrative embodiment.

A first x-y transmission coefficient curve 1300 is shown for bit state 00, a second x-y transmission coefficient curve 1302 is shown for bit state 01, a second x-y transmission coefficient curve 1304 is shown for bit state 10, a fourth x-y transmission coefficient curve 1306 is shown for bit state 11. Referring to FIG. 14, a simulated x-y transmission phase response is shown that was generated by phase-shifting waveguide 110 as a function of frequency in accordance with an illustrative embodiment. A first x-y transmission phase response curve 1400 is shown for bit state 00, a second x-y transmission phase response curve 1402 is shown for bit state 01, a second x-y transmission phase response curve 1404 is shown for bit state 10, a fourth x-y transmission phase response curve 1406 is shown for bit state 11. Phase-shifting waveguide 110 exhibited a wide operating bandwidth of almost an octave over which the co-polarization transmission coefficients were greater than −2 dB, and the transmission phases were within +/−15° of corresponding desired values for the four operating states.

Figure 15:
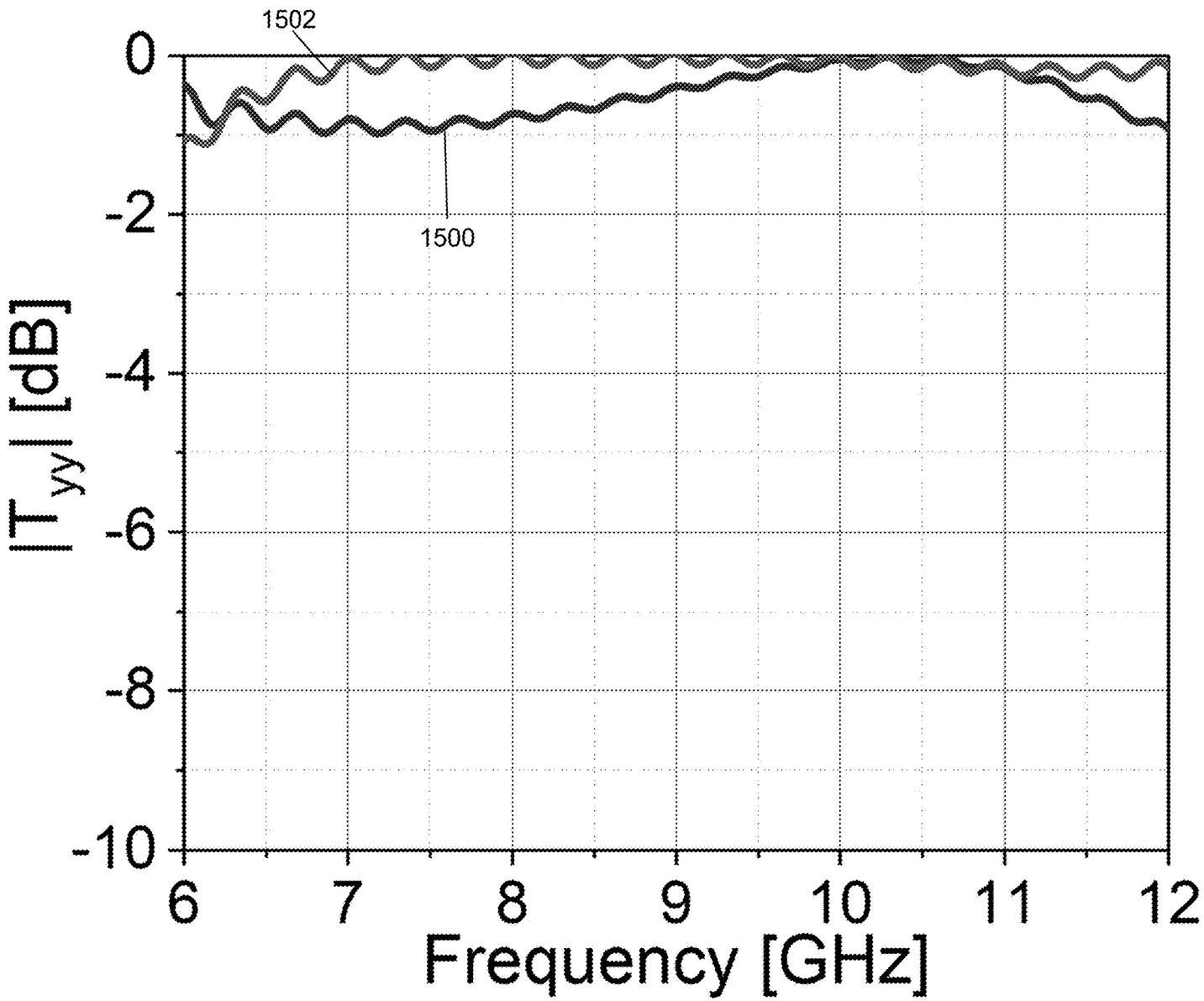
FIG. 15 depicts magnitudes of simulated y-y transmission coefficients corresponding to four operating modes of the reconfigurable double-ridge waveguide of FIGS. 7 and 9 as a function of frequency in accordance with an illustrative embodiment.
Figure 16:
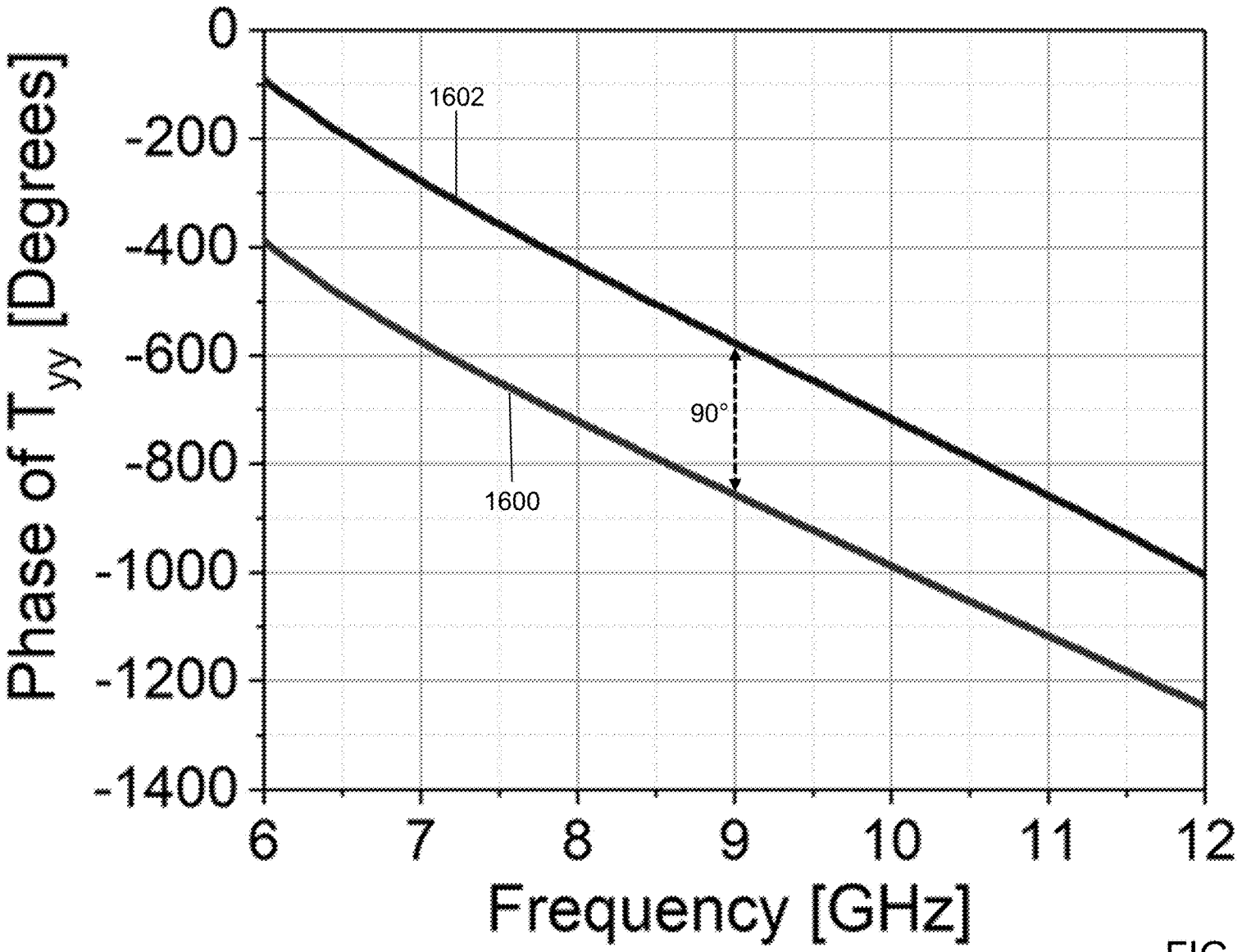
FIG. 16 depicts phases of simulated y-y transmission coefficients corresponding to four operating modes of the reconfigurable double-ridge waveguide of FIGS. 7 and 9 as a function of frequency in accordance with an illustrative embodiment.

Referring to FIG. 15, a simulated y-y transmission coefficient is shown that was generated by first reconfigurable double-ridge waveguide 200*a* as a function of frequency in accordance with an illustrative embodiment. A first y-y transmission coefficient curve 1500 is shown for a 0° phase rotation, and a second y-y transmission coefficient curve 1502 is shown for a 90° phase rotation. Referring to FIG. 16, a simulated y-y transmission phase response is shown that was generated by first reconfigurable double-ridge waveguide 200*a* as a function of frequency in accordance with an illustrative embodiment. A first y-y transmission phase response curve 1600 is shown for a 0° phase rotation, and a second y-y transmission phase response curve 1602 is shown for a 90° phase rotation. First reconfigurable double-ridge waveguide 200*a* achieved approximately 90° of phase shift over the frequency range of 6 to 12 gigahertz (GHz) with y-polarization transmission coefficients greater than −1 dB.

Figure 17:
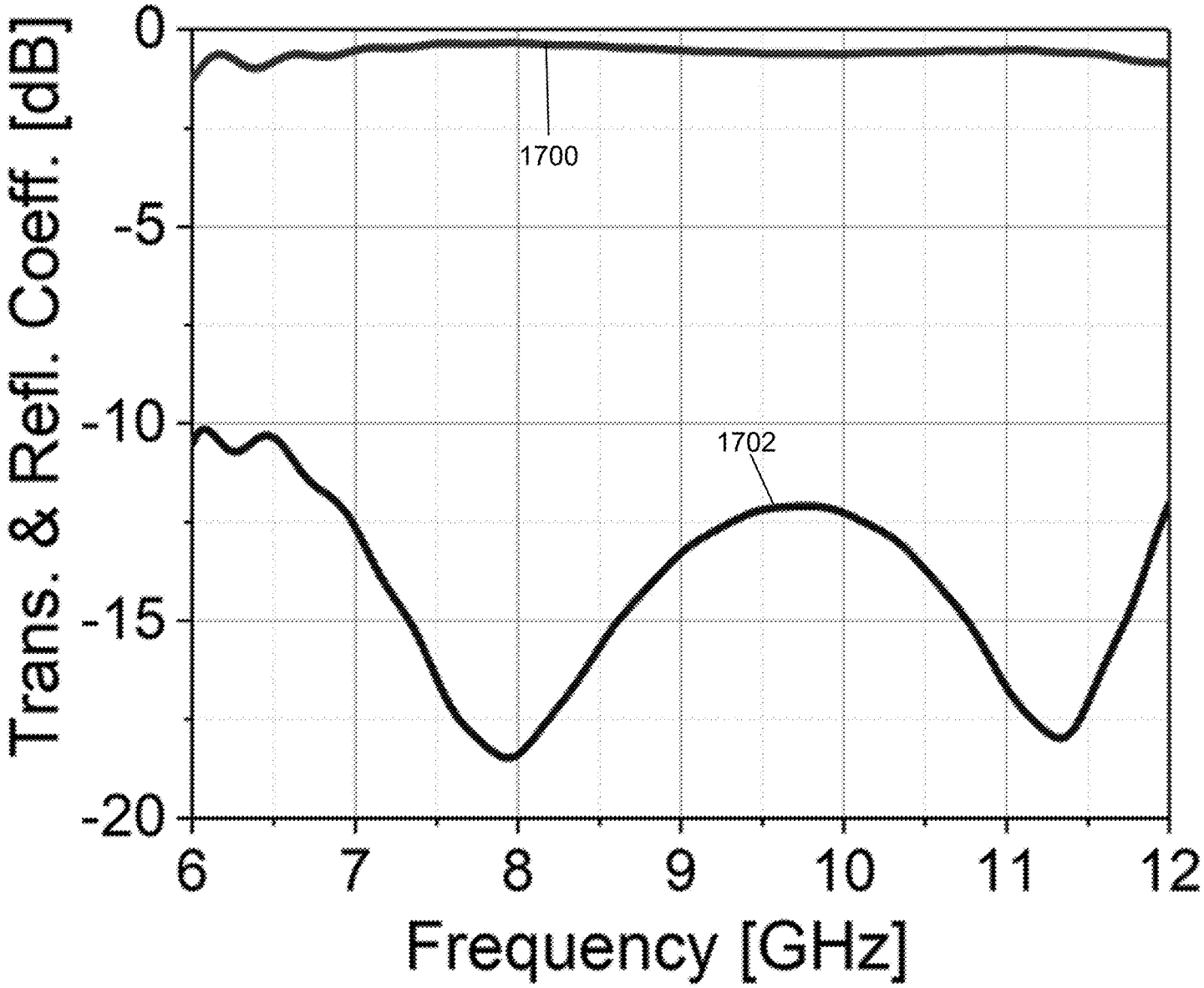
FIG. 17 depicts magnitudes of simulated x-y transmission coefficient and a simulated y-y reflection coefficient generated by the polarization rotator of FIG. 11A as a function of frequency in accordance with an illustrative embodiment.
Figure 18:
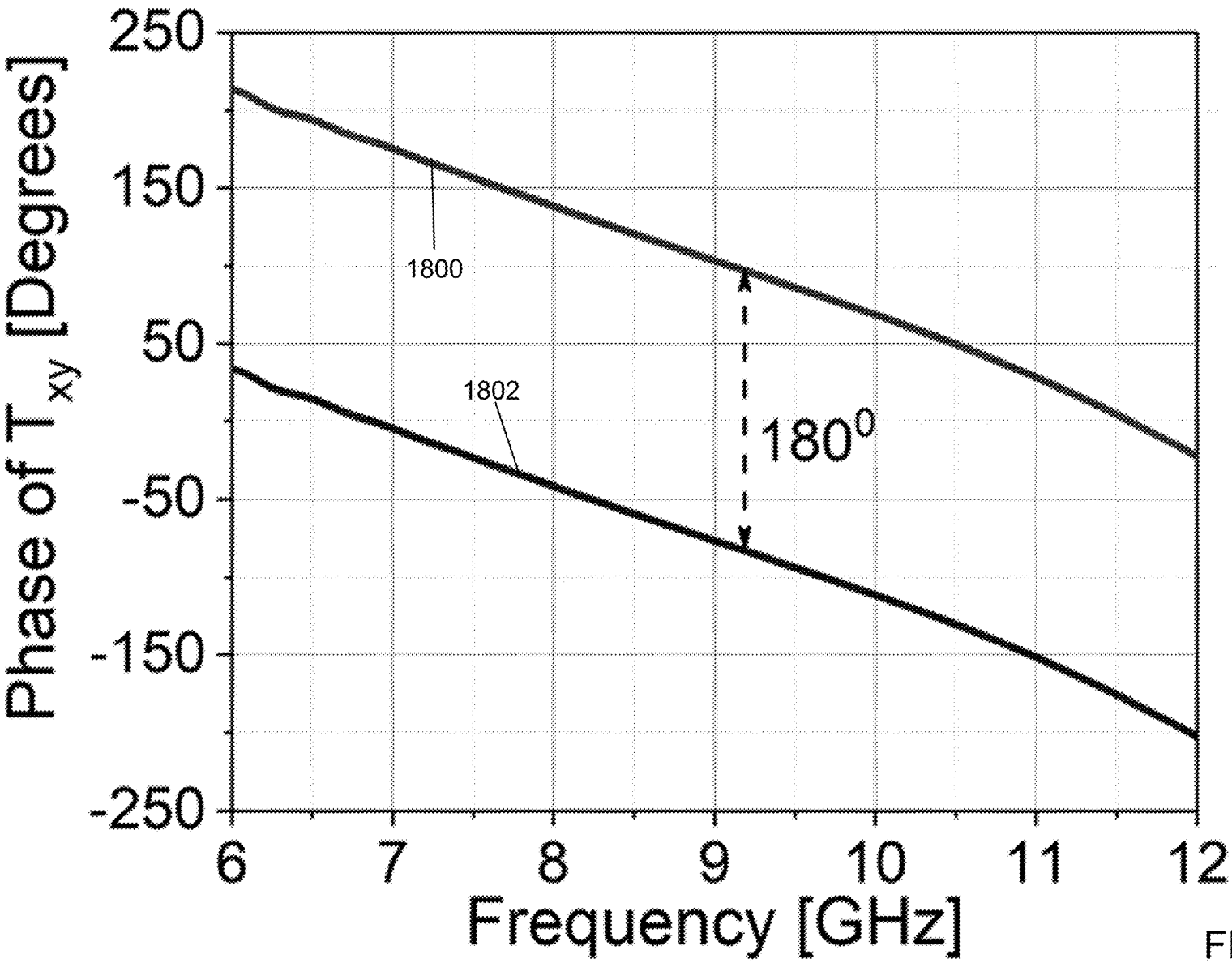
FIG. 18 depicts phases of simulated x-y transmission coefficients corresponding to two operating modes of the polarization rotator of FIG. 11A as a function of frequency in accordance with an illustrative embodiment.

Referring to FIG. 17, a simulated x-y transmission coefficient and a simulated y-y reflection coefficient are shown that was generated by first polarization rotator 202*a* as a function of frequency in accordance with an illustrative embodiment. An x-y transmission coefficient curve 1700 and an x-y reflection coefficient curve 1702 are shown. Referring to FIG. 18, a simulated x-y transmission phase response is shown that was generated by first polarization rotator 202*a* as a function of frequency in accordance with an illustrative embodiment. A first x-y transmission phase response curve 1600 is shown for the third signal, and a second x-y transmission phase response curve 1602 is shown for the fourth signal. First polarization rotator 202*a* achieved approximately 180° of phase shift over the frequency range of 6 to 12 gigahertz (GHz) with cross-polarization transmission coefficients greater than −1 dB.

As used herein, the term "mount" includes join, unite, connect, couple, associate, insert, hang, hold, affix, attach, fasten, bind, paste, secure, bolt, screw, rivet, solder, weld, glue, form over, form in, layer, mold, rest on, rest against, etch, abut, and other like terms. The phrases "mounted on", "mounted to", and equivalent phrases indicate any interior or exterior portion of the element referenced. These phrases also encompass direct mounting (in which the referenced elements are in direct contact) and indirect mounting (in which the referenced elements are not in direct contact, but are connected through an intermediate element). Elements referenced as mounted to each other herein may further be integrally formed together, for example, using a molding or a thermoforming process as understood by a person of skill in the art. As a result, elements described herein as being mounted to each other need not be discrete structural elements. The elements may be mounted permanently, removably, or releasably unless specified otherwise.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, using "and" or "or" in the detailed description is intended to include "and/or" unless specifically indicated otherwise. The illustrative embodiments may be implemented as a method, apparatus, or article of manufacture using standard programming and/or engineering techniques to produce software, firmware, hardware, or any combination thereof to control a computer to implement the disclosed embodiments.

Any directional references used herein, such as left-side, right-side, top, bottom, back, front, up, down, above, below, etc., are for illustration only based on the orientation in the drawings selected to describe the illustrative embodiments.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated.

What is claimed is:

1. A waveguide comprising:

a first double-ridge waveguide formed of a first electrically conductive material, wherein the first double-ridge waveguide is configured to generate a first electric field having a first polarization in response to an input electrical field having the first polarization or to generate a second electric field having the first polarization in response to the input electrical field, wherein a first phase of the first electric field is rotated 0 degrees relative to a phase of the input electrical field when the input electrical field is applied to the first double-ridge waveguide, wherein a second phase of the second electric field is rotated 90 degrees relative to the phase of the input electrical field when the input electrical field is applied to the first double-ridge waveguide;

a second double-ridge waveguide formed of a second electrically conductive material, wherein the second double-ridge waveguide is configured to generate a third electric field with a polarization that is perpendicular to the first polarization; and a polarization rotator mounted between the first double-ridge waveguide and the second double-ridge waveguide, wherein the polarization rotator comprises a frame;

a dielectric layer including a first dielectric surface and a second dielectric surface formed within the frame, wherein the first dielectric surface is on an opposite side of the dielectric layer relative to the second dielectric surface, wherein the first dielectric surface is mounted adjacent an output side of the first double-ridge waveguide, wherein the second dielectric surface is mounted adjacent an input side of the second double-ridge waveguide, wherein the dielectric layer is formed of a dielectric material;

a first conducting pattern layer formed of a third electrically conductive material mounted to the first dielectric surface, wherein the first conducting pattern layer includes a first conductor and a second conductor;

a first switch connected between the first conductor and the second conductor to electrically connect the first conductor to the second conductor or to electrically disconnect the first conductor from the second conductor;

a second conducting pattern layer formed of a fourth electrically conductive material mounted to the second dielectric surface, wherein the second conducting pattern layer includes a third conductor and a fourth conductor; and a second switch connected between the third conductor and the fourth conductor to electrically connect the third conductor to the fourth conductor or to electrically disconnect the third conductor from the fourth conductor, wherein, when the first switch electrically connects the first conductor to the second conductor, the second switch electrically disconnects the third conductor from the fourth conductor to define a first mode of the polarization rotator, wherein, when the second switch electrically connects the third conductor to the fourth conductor, the first switch electrically disconnects the first conductor from the second conductor to define a second mode of the polarization rotator, wherein the first mode is configured to rotate the first phase of the first electric field or the second phase of the second electric field by 90 degrees, wherein the second mode is configured to rotate the first phase of the first electric field or the second phase of the second electric field by −90 degrees.

2. The waveguide of claim 1, wherein at least one of the first electrically conductive material, the second electrically conductive material, the third electrically conductive material, and the fourth electrically conductive material is a different electrically conductive material.

3. The waveguide of claim 1, wherein the first switch and the second switch are single pole, single throw switches.

4. The waveguide of claim 1, wherein the first switch comprises:

a diode connected between the first conductor and the second conductor;

a first bias line connected to a first end of the first conductor opposite where the diode is connected to the first conductor; and a second bias line connected to a first end of the second conductor opposite where the diode is connected to the second conductor.

5. The waveguide of claim 4, wherein the diode is a PIN diode.

6. The waveguide of claim 1, wherein the first conductor, the second conductor, the third conductor, and the fourth conductor each have a crossed-dipole shape.

7. The waveguide of claim 1, wherein the first conductor, the second conductor, the third conductor, and the fourth conductor each have an arrow shape comprised of a first arrow tip arm, a second arrow tip arm, and a shaft.

8. The waveguide of claim 7, wherein the first arrow tip arm is perpendicular to the second arrow tip arm.

9. The waveguide of claim 7, wherein the shaft of the first conductor is rotated by 180 degrees relative to the second conductor, the shaft of the third conductor is rotated by 180 degrees relative to the fourth conductor, the shaft of the third conductor is rotated by 90 degrees relative to the first conductor, and the shaft of the third conductor is rotated by 90 degrees relative to the fourth conductor.

10. The waveguide of claim 7, wherein each arrow shape of the first conductor and the second conductor is pointed outward from a center of the first dielectric surface and each arrow shape of the third conductor and the fourth conductor is pointed outward from a center of the second dielectric surface.

11. The waveguide of claim 10, wherein the first switch comprises:

a diode connected between a first location on the first conductor and a second location on the second conductor, wherein the first location is an end of the shaft of the first conductor opposite a tip of the first conductor and the second location is an end of the shaft of the second conductor opposite a tip of the second conductor;

a first bias line connected to the tip of the first conductor; and a second bias line connected to the tip of the second conductor.

12. The waveguide of claim 11, wherein a voltage applied to the first bias line or to the second bias line controls whether the first switch electrically connects the first conductor to the second conductor or electrically disconnects the first conductor from the second conductor.

13. The waveguide of claim 10, wherein the frame has four walls that join to form a polygon, wherein a tip of the arrow shape of the first conductor, of the second conductor, of the third conductor, and of the fourth conductor is pointed toward a different corner of the frame, wherein each wall of the four walls is parallel to a wall of the first double-ridge waveguide.

14. The waveguide of claim 1, wherein a first electrical path length of the first conductor and the second conductor when the first switch electrically connects the first conductor to the second conductor is approximately a half of a wavelength $\lambda_0/2$, where $\lambda_0=c/f_0$, where c is a speed of light, and $f_0$ is a central operating frequency of the input electrical field.

15. The waveguide of claim 1, wherein the second double-ridge waveguide comprises:

a top wall, a right side wall, a bottom wall, and a left side wall mounted to each other to form a hollow polygon;

a first ridge that extends perpendicularly to the left from the right side wall toward the left side wall; and a second ridge that extends perpendicularly to the right from the left side wall toward the right side wall.

16. The waveguide of claim 1, wherein the first double-ridge waveguide comprises:

a top wall, a right side wall, a bottom wall, and a left side wall mounted to each other to form a hollow polygon;

a first ridge that extends perpendicularly down from the top wall toward the bottom wall, wherein a plurality of teeth is formed in the first ridge that are open toward the bottom wall;

a second ridge that extends perpendicularly up from the bottom wall toward the top wall;

an actuator mounted to the second ridge; and a plate formed of a fifth electrically conductive material mounted parallel to a top surface of the second ridge, the plate mounted to the actuator, wherein the actuator is configured to move the plate toward or away from the plurality of teeth.

17. The waveguide of claim 16, comprising a second actuator, wherein the actuator is mounted to a first end of the plate, and the second actuator is mounted to a second end of the plate opposite the first end, wherein the second actuator is configured to move the plate toward or away from the plurality of teeth in combination with the actuator to maintain the plate parallel to the top surface of the second ridge.

18. The waveguide of claim 16, wherein, when the plate is moved to a first position relative to the second ridge, the first electric field is generated, and, when the plate is moved to a second position relative to the second ridge, the second electric field is generated.

19. The waveguide of claim 1, wherein the first double-ridge waveguide comprises:

a top wall, a right side wall, a bottom wall, and a left side wall mounted to each other to form a hollow polygon;

a first ridge that extends perpendicularly down from the top wall toward the bottom wall, wherein a plurality of teeth is formed in the first ridge that are open toward the bottom wall;

a second ridge that extends perpendicularly up from the bottom wall toward the top wall;

a plate formed of a fifth electrically conductive material mounted parallel to a top surface of the second ridge between the plurality of teeth and the top surface of the second ridge;

a first diode connected to the plate at a first end; and a second diode connected to the plate at a second end opposite the first end, wherein, when the first diode and the second diode provide electrical current to the plate, the first electric field is generated, and, when the first diode and the second diode do not provide electrical current to the plate, the second electric field is generated.

20. A phased array antenna comprising:

a transmitter;

a plurality of radiating antennas; and a plurality of waveguides wherein each waveguide of the plurality of waveguides is mounted to receive electrical energy from the transmitter and to provide electrical energy to a respective radiating antenna of the plurality of radiating antennas, wherein each waveguide of the plurality of waveguides comprises a first double-ridge waveguide formed of a first electrically conductive material, wherein the first double-ridge waveguide is configured to generate a first electric field having a first polarization in response to an input electrical field having the first polarization or to generate a second electric field having the first polarization in response to the input electrical field, wherein a first phase of the first electric field is rotated 0 degrees relative to a phase of the input electrical field when the input electrical field is applied to the first double-ridge waveguide, wherein a second phase of the second electric field is rotated 90 degrees relative to the phase of the input electrical field when the input electrical field is applied to the first double-ridge waveguide;

a second double-ridge waveguide formed of a second electrically conductive material, wherein the second double-ridge waveguide is configured to generate a third electric field with a polarization that is perpendicular to the first polarization; and a polarization rotator mounted between the first double-ridge waveguide and the second double-ridge waveguide, wherein the polarization rotator comprises a frame;

a dielectric layer including a first dielectric surface and a second dielectric surface formed within the frame, wherein the first dielectric surface is on an opposite side of the dielectric layer relative to the second dielectric surface, wherein the first dielectric surface is mounted adjacent an output side of the first double-ridge waveguide, wherein the second dielectric surface is mounted adjacent an input side of the second double-ridge waveguide, wherein the dielectric layer is formed of a dielectric material;

a first conducting pattern layer formed of a third electrically conductive material mounted to the first dielectric surface, wherein the first conducting pattern layer includes a first conductor and a second conductor;

a first switch connected between the first conductor and the second conductor to electrically connect the first conductor to the second conductor or to electrically disconnect the first conductor from the second conductor;

a second conducting pattern layer formed of a fourth electrically conductive material mounted to the second dielectric surface, wherein the second conducting pattern layer includes a third conductor and a fourth conductor; and a second switch connected between the third conductor and the fourth conductor to electrically connect the third conductor to the fourth conductor or to electrically disconnect the third conductor from the fourth conductor, wherein, when the first switch electrically connects the first conductor to the second conductor, the second switch electrically disconnects the third conductor from the fourth conductor to define a first mode of the polarization rotator, wherein, when the second switch electrically connects the third conductor to the fourth conductor, the first switch electrically disconnects the first conductor from the second conductor to define a second mode of the polarization rotator, wherein the first mode is configured to rotate the first phase of the first electric field or the second phase of the second electric field by 90 degrees, wherein the second mode is configured to rotate the first phase of the first electric field or the second phase of the second electric field by −90 degrees.

* * * * *